US011754325B2

(12) United States Patent
Kniffler

(10) Patent No.: US 11,754,325 B2
(45) Date of Patent: Sep. 12, 2023

(54) HEAT PUMP HAVING A COOLING DEVICE FOR COOLING A GUIDE SPACE OR A SUCTION MOUTH

(71) Applicant: Efficient Energy GmbH, Feldkirchen (DE)

(72) Inventor: Oliver Kniffler, Sauerlach (DE)

(73) Assignee: EFFICIENT ENERGY GMBH, Feldkirchen (DE)

( * ) Notice: Subject to any disclaimer, the term of this patent is extended or adjusted under 35 U.S.C. 154(b) by 261 days.

(21) Appl. No.: 16/793,260

(22) Filed: Feb. 18, 2020

(65) Prior Publication Data

US 2020/0200447 A1 Jun. 25, 2020

Related U.S. Application Data

(63) Continuation of application No. PCT/EP2018/072548, filed on Aug. 21, 2018.

(30) Foreign Application Priority Data

Aug. 29, 2017 (DE) ..... 10 2017 215 085.8

(51) Int. Cl.
*F25B 30/02* (2006.01)
*F25B 31/00* (2006.01)
*F25B 31/02* (2006.01)

(52) U.S. Cl.
CPC ..... *F25B 30/02* (2013.01); *F25B 31/006* (2013.01); *F25B 31/026* (2013.01); *F25B 2500/09* (2013.01)

(58) Field of Classification Search
CPC ..... F25B 30/02; F25B 31/006; F25B 31/026; F25B 2500/09; F25B 2400/071; F25B 31/008
See application file for complete search history.

(56) References Cited

U.S. PATENT DOCUMENTS 5,200,008 A 4/1993 Enterline et al.
7,841,201 B2 11/2010 Sedlak et al.
(Continued)

FOREIGN PATENT DOCUMENTS

CN 1383477 A 12/2002
CN 101896778 A 11/2010
(Continued)

OTHER PUBLICATIONS

Japanese Office Action, dated Feb. 24, 2021, in parallel patent application No. 2020-511953 (with English Translation).
(Continued)

*Primary Examiner* — Ana M Vazquez
(74) *Attorney, Agent, or Firm* — McClure, Qualey & Rodack, LLP

(57) ABSTRACT

A heat pump, having: an evaporator for evaporating a working liquid; a liquefier for condensing a compressed working vapor; a compressor motor with a suction mouth having attached thereto a radial impeller to convey a working vapor evaporated in the evaporator through the suction mouth; a guide space arranged to guide a working vapor conveyed by the radial impeller into the condenser; and a cooling device for cooling the guide space or the suction mouth with a liquid, wherein the cooling device is configured to guide the liquid onto an outside of the guide space or of the suction mouth, wherein the outside is not in contact with the working vapor, and wherein an inside of the guide space or of the suction mouth is in contact with the working vapor.

22 Claims, 12 Drawing Sheets

(56) References Cited

U.S. PATENT DOCUMENTS

| | | | | |
|---|---|---|---|---|
| 8,978,408 | B2 | 3/2015 | Sedlak et al. | |
| 9,803,899 | B2 | 10/2017 | Sedlak et al. | |
| 2002/0106278 | A1 | 8/2002 | Koga | |
| 2009/0100857 | A1* | 4/2009 | Ophir | F25C 1/16 239/14.2 |
| 2010/0287969 | A1 | 11/2010 | Ueda et al. | |
| 2011/0107787 | A1 | 5/2011 | Sedlak et al. | |
| 2012/0102991 | A1 | 5/2012 | Lee et al. | |
| 2015/0033790 | A1 | 2/2015 | Yamada et al. | |
| 2015/0276282 | A1 | 10/2015 | Heiden et al. | |
| 2017/0102003 | A1 | 4/2017 | Sishtla | |
| 2017/0211584 | A1 | 7/2017 | Taguchi et al. | |

FOREIGN PATENT DOCUMENTS

| | | | |
|---|---|---|---|
| CN | 102466374 | A | 5/2012 |
| CN | 104081064 | A | 10/2014 |
| CN | 104457027 | A | 3/2015 |
| DE | 26 04 942 | A1 | 8/1977 |
| DE | 44 31 887 | A1 | 3/1995 |
| DE | 10 2008 016 663 | A1 | 10/2009 |
| DE | 10 2016 203 407 | A1 | 9/2017 |
| EP | 2 016 349 | B2 | 1/2009 |
| JP | 2009150594 | A | 7/2009 |
| JP | 2011517760 | A | 6/2011 |
| WO | 2013/125215 | A1 | 8/2013 |
| WO | 2014/072239 | A1 | 5/2014 |
| WO | 2017/148932 | A1 | 9/2017 |

OTHER PUBLICATIONS

Chinese Office Action, dated Mar. 5, 2021, in patent application No. 201880056900.4 with English Translation.

International Search Report and written opinion, dated Mar. 18, 2019.

International Search Report, dated Mar. 16, 2019.

European Office Action dated May 4, 2018, issued in application No. 10 2017 215 085.8.

* cited by examiner (top view of the guide space)

(view of the suction mouth/guide space from below)

schematic view of the cover from below

| P[hPa] | 8 | 12 | 30 | 60 | 100 | 1000 |
|---|---|---|---|---|---|---|
| evaporation temperature | 4°C | 12°C | 24°C | 36°C | 45°C | 100°C |

HEAT PUMP HAVING A COOLING DEVICE FOR COOLING A GUIDE SPACE OR A SUCTION MOUTH

CROSS-REFERENCES TO RELATED APPLICATIONS

This application is a continuation of copending International Application No. PCT/EP2018/072548, filed Aug. 21, 2018, which is incorporated herein by reference in its entirety, and additionally claims priority from German Application No. DE 10 2017 215 085.8, filed Aug. 29, 2017, which is incorporated herein by reference in its entirety.

BACKGROUND OF THE INVENTION

FIG. 8A and FIG. 8B illustrate a heat pump as is described in the European patent EP 2016349 B1. First, the heat pump includes an evaporator 10 for evaporating water as a working liquid in order to generate vapor in a working vapor line 12 on the output side. The evaporator includes an evaporation space (not shown in FIG. 8A) and is configured to generate an evaporation pressure of less than 20 hPa in the evaporation space so that the water evaporates in the evaporation space at temperatures below 15'C. For example, water is ground water, brine that circulates freely in the ground or in collector pipes, i.e. water with a certain salt content, river water, lake water or sea water. All types of water, i.e. water containing lime, water free of lime, water containing salt or water free of salt, may be used. This is due to the fact that all types of water, i.e. all these "hydrogens", have the favorable water property, i.e. the fact that the enthalpy difference ratio of water, which is also known as "R 718", which may be used for the heat pump process amounts to 6, which corresponds to more than two times the typical usable enthalpy difference ratio of, e.g. R134a.

The water vapor is provided through the suction line 12 to a compressor/liquefier system 14 comprising a turbo-machine such as a radial compressor, e.g. In the form of a turbo compressor, designated with 16 in FIG. 8A. The turbo-machine is configured to compress the working vapor to a vapor pressure of at least more than 25 hPa. 25 hPa corresponds to a liquefaction temperature of approximately 22° C., which may already be a sufficient heating advance flow line temperature for underfloor heating, at least on relatively warm days. In order to generate higher flow temperatures, pressures greater than 30 hPa may be generated with the turbo-machine 16, wherein a pressure of 30 hPa has a liquefaction temperature of 24° C., a pressure of 60 hPa has a liquefaction temperature of 36° C., and a pressure of 100 hPa corresponds to a liquefaction temperature of 45° C. Underfloor heating systems are configured to heat sufficiently with a flow temperature of 45° C. even on very cold days.

The turbo-machine is coupled with a liquefier 18 configured to liquefy the compressed working vapor. Through liquefying, the energy contained in the working vapor is provided to the liquefier 18 in order to be provided to a heating system through the advance flow line 20*a*. The working liquid then flows back into the liquefier through the return flow line 20*b*.

According to the above-stated example, it is advantageous to extract the heat (energy) absorbed by the energy-rich water vapor directly through the colder heating water, the heat being absorbed by the heating water so that it heats up. Here, so much energy is extracted from the vapor that it is condensed and also takes part it heating circuit.

FIG. 8B shows a table for illustrating different pressures and the evaporation temperatures associated with these pressures, resulting in the fact that rather low pressures have to be selected in the evaporator, especially for water as a working medium.

DE 4431887 A1 discloses a heat pump system with a lightweight, large-volume high-performance centrifugal compressor. Vapor leaving a second-stage compressor has a saturation temperature that exceeds the ambient temperature or that of available cooling water, which allows for heat dissipation. The compressed vapor is transferred by the second-stage compressor into the condenser unit consisting of a bulk layer that is provided within a cooling water spray unit on a top side, which is fed by a water circulation pump. The compressed water vapor rises in the condenser through the bulk layer where it comes into direct counter-flow contact with the cooling water that flows downwards. The vapor condenses and the latent heat of the condensation absorbed by the cooling water is ejected to the atmosphere via the condensate and the cooling water that are together removed from the system. The condenser is continuously flushed with non-condensable gases through a pipeline by means of a vacuum pump.

WO 2014072239 A1 discloses a liquefier having a condensation zone for a condensing vapor to be condensed in a working liquid. The condensation zone is configured as a volume zone and has a lateral boundary between the upper end of the condensation zone and the lower end. Furthermore, the liquefier includes a vapor introduction zone extending along the lateral end of the condensation zone and configured to supply vapor to be condensed laterally over the lateral boundary into the condensation zone. With this, without increasing the volume of the liquefier, the actual condensation becomes a volume condensation since the vapor to be liquefied is not only introduced frontally from one side into a condensation volume, or into the condensation zone, but laterally and advantageously from all sides. This not only ensures that the condensation volume provided is increased at the same external dimensions as compared to a direct counter-flow condensation, but that the efficiency of the condenser is simultaneously improved since the vapor to be liquefied in the condensation zone comprises a flow direction transverse to the flow direction of the condensation liquid.

A general problem with heat pumps is the fact that moving parts and in particular fast moving parts need to be cooled. Here, the compressor motor and especially the motor shaft are particularly problematic. Particularly for heat pumps which use radial impellers as compressors, which are operated very quickly in order to achieve a small design, e.g. in regions larger than 50,000 revolutions per minute, shaft temperatures may reach values that are problematic since they may lead to destruction of the components.

A further generally problematic disadvantage of heat pumps using a compressor motor with a radial impeller is that the activity of the radial impeller and the guide space arranged downstream causes the working vapor to overheat considerably. Overheated working vapor and in particular overheated water vapor, when using water as the working medium, has a higher viscosity and therefore a greater flow resistance than saturated vapor.

In principle, overheated working medium vapor is to first reduce its overheating in order to be able to then condense particularly well and efficiently. However, efficient condensation is particularly important in order to achieve a heat pump which, on the one hand, creates high performance values for heating or cooling, depending on the use of the heat pump. In addition, a heat pump should take up as little space as possible, placing limitations on the size of the condenser. The smaller the condenser is dimensioned, the smaller the "footprint" or the volume or space occupied by the heat pump will be. It is therefore of great importance to achieve highly-efficient condensation in the condenser of a heat pump. Only then, a heat pump having good efficiency and not having too large of a volume or footprint may be created.

SUMMARY

According to an embodiment, a heat pump may have: an evaporator for evaporating a working liquid; a liquefier for condensing a compressed working vapor; a compressor motor with a suction mouth having attached thereto a radial impeller to convey a working vapor evaporated in the evaporator through the suction mouth; a guide space arranged to guide a working vapor conveyed by the radial impeller into the condenser; and a cooling device for cooling the guide space or the suction mouth with a liquid, wherein the cooling device is configured to guide the liquid onto an outside of the guide space or of the suction mouth, wherein the outside is not in contact with the working vapor, and wherein an inside of the guide space or of the suction mouth is in contact with the working vapor.

Another embodiment may have a method for pumping heat with an evaporator for evaporating a working liquid: a liquefier for condensing a compressed working vapor; a compressor motor with a suction mouth having attached thereto a radial impeller to convey a working vapor evaporated in the evaporator through the suction mouth; and a guide space arranged to guide a working vapor conveyed by the radial impeller into the condenser, having the steps of: cooling the guide space or the suction mouth with a liquid, wherein the liquid is guided onto an outside of the guide space or of the suction mouth, wherein the outside is not in contact with the working vapor and wherein an inside of the guide space or of the suction mouth is in contact with the working vapor.

Another embodiment may have a method for manufacturing a heat pump with an evaporator for evaporating a working liquid; a liquefier for condensing a compressed working vapor; a compressor motor with a suction mouth having attached thereto a radial impeller to convey a working vapor evaporated in the evaporator through the suction mouth; and a guide space arranged to guide a working vapor conveyed by the radial impeller into the condenser, having the steps of: attaching a cooling device for cooling the guide space or the suction mouth with a liquid, wherein the cooling device is arranged to guide the liquid onto an outside of the guide space or of the suction mouth, wherein the outside is not in contact with the working vapor and wherein an inside of the guide space or of the suction mouth is in contact with the working vapor.

The present invention is based on the finding that cooling of the guide space and/or the suction mouth with a liquid is employed in order to avoid a reduced condenser efficiency due to an overheated working medium vapor. With this, the temperature of the guide space and/or the suction mouth is brought and maintained as close as possible to the saturation pressure temperature of the pressure prevailing in the liquefier. Thus, energy/heat from the vapor flow is coupled in via the material, or wall, of the suction mouth or the guide space. If water is used as the working liquid, which is the case in embodiments, the water brought to the suction mouth or guide space starts to boil and therefore releases its energy. The guide space and/or the suction mouth are therefore kept very close to the saturated vapor temperature of the vapor pressure that is first sucked in by the radial impeller via the suction mouth element and is fed into the contacting space from there. The working vapor is then compressed in the guide space to its intended liquefier, or condenser, pressure. Cooling the guide space and/or the suction mouth therefore prevents the working medium vapor from overheating too much. When entering the condenser, the working medium vapor therefore no longer has to reduce its overheating in order to be able to condense easily. Instead, the working medium vapor may directly condense in the condenser without further loses with respect to time or volume or running distance. With this, an efficient condenser may be achieved even if the condenser volume is made smaller compared to an embodiment that would not have employed a corresponding guide space/suction mouth cooling.

In embodiments of the present invention, the guide space is configured of a thermally well-conducting material. In this way, the guide space extracts energy from the vapor flowing past it and transfers it directly to the cooling water that flows around the guide space or the suction mouth. With this, the guide space is kept even better at the saturated vapor temperature of the vapor pressure. On the other hand, liquefaction in the guide space is prevented due to the remaining thermal resistance of the material of the guide space, as the overheating is not fully reduced, but only to a large extent. However, this remaining overheating ensures that condensation does not already take place in the guide space but only in the liquefier where it takes place particularly efficiently.

In embodiments of the present invention, the cooling liquid for the guide space is previously guided through a motor ball bearing and/or through an open motor cooling that is advantageously used. Through the open motor cooling, the cooling liquid is again cooled down through partial evaporation back to the saturated vapor temperature. In the cascade of the ball bearing cooling and the motor cooling, the cooling liquid releases the energy absorbed through the ball bearing cooling already in the motor cooling. Thus, an optimally tempered liquid medium is provided for the open guide space cooling.

In implementations, the upper part of the outside of the guide space is first filled with liquid. In such a one-sided guide space cooling, the working liquid would then simply overflow, which is unproblematic or even desired, since the working liquid then simply flows into the condenser, into which, in embodiments of the present invention, working liquid is introduced in any case in the form of a "shower". In further embodiments, the cooling liquid is further guided from the upper guide space cooling, i.e. the cooling of the top side of the guide space, into an additional lower guide space cooling and/or suction mouth cooling. At the end of the guide space there is an open area with an overflow. Through evaporation, the working liquid constantly cools itself down to the saturated vapor temperature. The remaining working liquid also overflows and simply flows into the condenser volume in order to be further processed accordingly. Alternatively, however, the working liquid may also be a working liquid that is not the working liquid of the heat pump, especially since the working liquid does not necessarily have to come into contact with the compressed working vapor according to the implementation.

The present invention is further advantageous in that thermal component loads are further reduced by the guide space cooling and/or the suction mouth cooling, which typically take up relatively large surfaces in a heat pump, being arranged close to the compressor. Due to the liquid cooling used, which advantageously takes place at the pressure level prevailing in the condenser, a highly-efficient evaporation cooling is achieved. Through this evaporation cooling, the entire compressor may be kept close to the saturated vapor temperature. In embodiments, motor losses, bearing losses and overheating in the compression are essentially reduced through evaporation in order to achieve not only a highly efficient heat pump, but also a heat pump that is safe and stable in operation.

Further aspects and advantages of embodiments are presented in the following.

The heat pump according to a further aspect includes a special convective shaft cooling. This heat pump comprises a condenser having a condenser housing, a compressor motor attached to the condenser housing and having a rotor and a stator, wherein the rotor comprises a motor shaft having a radial impeller attached thereto which extends into an evaporator zone, and a guide space configured to receive vapor compressed by the radial impeller and to guide the same into the condenser. In addition, the heat pump comprises a motor housing surrounding the compressor motor and advantageously configured to maintain a pressure that is at least the same as the pressure in the condenser. However, a pressure that is larger than the pressure behind the radial impeller is also sufficient. In certain implementations, this pressure is set to a pressure that is in the middle between the condenser pressure and the evaporator pressure. In addition, a vapor feed is provided in the motor housing in order to feed vapor in the motor housing to a motor gap between the stator and the motor shaft. Furthermore, the motor is configured such that a further gap extends from the motor gap between the stator and the motor shaft along the radial impeller to the guide space.

This results in a relatively high pressure in the motor housing, being higher than the mean pressure from the condenser and the evaporator and advantageously the same as or higher than the condenser pressure, while a lower pressure is present in the wider gap that extends along the radial impeller to the guide space. This pressure, which is the same as the mean pressure from the condenser and the evaporator, prevails due to the fact that the radial impeller creates a high pressure area in front of the radial impeller and a low pressure or vacuum area behind the radial impeller when compressing the vapor from the evaporator. In particular, the high pressure area in front of the radial impeller is still smaller than the high pressure in the condenser and the low pressure "behind" the radial impeller, so to speak, is still smaller than the high pressure at the exit of the radial impeller. The high condenser pressure is only present at the exit of the guide space.

This pressure gradient, which is "coupled" to the motor gap, ensures that working vapor is pulled from the motor housing through the vapor feed along the motor gap and the further gap into the condenser. This pressure is at the temperature level of the condenser working medium or above. However, this is especially advantageous since this avoids all condensation problems that would support corrosion etc. within the motor and in particular within the motor shaft.

In this aspect, the coldest working liquid available in the evaporator is therefore not used for the convective shaft cooling. The cold vapor in the evaporator is not used either. Instead, for the convective shaft cooling, the vapor present in the heat pump at condenser temperature is used. Due to the convective nature, this still provides sufficient shaft cooling, i.e. a significant and especially adjustable amount of vapor flows around the motor shaft due to the vapor feed and the motor gap and the further gap. At the same time, the fact that this vapor is relatively warm in contrast to the vapor in the evaporator ensures that there is no condensation along the motor shaft in the motor gap and/or the further gap. Instead, a temperature that is higher than the coldest temperature is created here. Condensation takes place at the lowest temperature in a volume and does therefore not take place within the motor gap and the further gap since they are surrounded by warm vapor.

This ensures a sufficient convective shaft cooling. This prevents excessive temperatures in the motor shaft and the associated wear and tear. In addition, condensation in the motor, e.g. when the heat pump is at a standstill, is effectively prevented. This also effectively eliminates all operational safety problems and corrosion problems that would be associated with such a condensation. According to the aspect of convective shaft cooling, the present invention leads to a significantly reliable heat pump.

In a further aspect that relates to a heat pump with motor cooling, the heat pump includes a condenser having a condenser housing, a compressor motor attached to the condenser housing and having a rotor and a stator. The rotor includes a motor shaft having attached thereto a compressor motor for compressing a working medium vapor. Furthermore, the compressor motor has a motor wall. The heat pump includes a motor housing surrounding the compressor motor and advantageously configured to maintain a pressure that is at least the same as the pressure in the condenser, and having a working liquid inlet for guiding a liquid working medium from the condenser to the motor wall in order to cool the motor. However, the pressure in the motor housing may here also be significantly lower since the heat dissipation from the motor housing takes place through boiling, or evaporation. The thermal energy at the motor wall is therefore mainly transported away through the vapor from the motor wall, wherein this heated vapor is then dissipated, e.g. into the condenser. Alternatively, the vapor from the motor cooling may also be brought into the evaporator or to the outside. However, guiding the heated vapor into the condenser is advantageous. In this aspect of the invention, in contrast to water cooling where a motor is cooled by water flowing past it, cooling takes place by evaporation so that the heat energy to be transported away is carried off by the provided vapor dissipation. One advantage is that less liquid is needed for cooling and that the vapor may be simply guided away, e.g. automatically into the condenser, where the vapor condenses again and therefore transfers the thermal output of the motor to the condenser liquid.

Thus, the motor housing is configured, during operation of the heat pump, to form a vapor space in which the working medium is located due to bubble boiling or evaporation. The motor housing is further configured to lead away the vapor from the vapor space in the motor housing through a vapor discharge. It is advantageously led away into the condenser so that the vapor discharge is achieved by a gas-permeable connection between the condenser and the motor housing.

The motor housing is advantageously further configured, during operation of the heat pump, to maintain a maximum level of liquid working medium in the motor housing, and to further form a vapor space above the maximum level. The motor housing is further configured to guide working mediums above the maximum level into the condenser. This implementation makes it possible to keep the cooling very robust through vapor generation, as the level of working liquid ensures that there is enough working liquid on the motor wall for bubble boiling. Alternatively, instead of the level of working liquid constantly maintained, a working liquid may be sprayed onto the motor wall. The sprayed liquid is then dosed in such a way that it evaporates when contacting the motor wall, thereby achieving the cooling capacity for the motor.

The motor is therefore effectively cooled on its motor wall with liquid working medium. However, this liquid working medium is not the cold working medium from the evaporator, but the warm working medium from the condenser. Using the warm working medium from the condenser nevertheless provides sufficient motor cooling. At the same time, however, it ensures that the motor is not cooled too much and in particular that it is not cooled to the point where it is a coldest part in the condenser, or on the condenser housing. This would lead to condensation of working medium vapor on the outside of the motor housing, e.g., when the motor is not running but also during operation, which would lead to corrosion and other problems. Instead, it is ensured that the motor is well cooled but is at the same time the warmest part of the heat pump so that condensation, which takes place at the coldest "end", does not occur at the compressor motor.

Preferably, the liquid working medium in the motor housing is kept at almost the same pressure as the condenser. This means that the working medium that cools the motor is close to its boiling point, as this working medium is a condenser working medium and is at a similar temperature as in the condenser. If the motor wall is now heated due to friction caused by motor operation, the thermal energy is transferred to the liquid working medium. Due to the fact that the liquid working medium is close to its boiling point, bubble boiling now starts in the motor housing in the liquid working medium that fills the motor housing up to a maximum level.

This bubble boiling enables an extremely efficient cooling due to the very strong mixing of the volume of liquid working medium in the motor housing. This boiling-assisted cooling may also be significantly assisted by a advantageously provided convection element, so that a very efficient motor cooling with a relatively small volume or no standing volume of liquid medium is eventually achieved, which, in addition, does not need to be controlled further because it is self-controlling. In this way, efficient motor cooling is achieved with a low technical effort, which in turn significantly contributes to an operational reliability of the heat pump.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
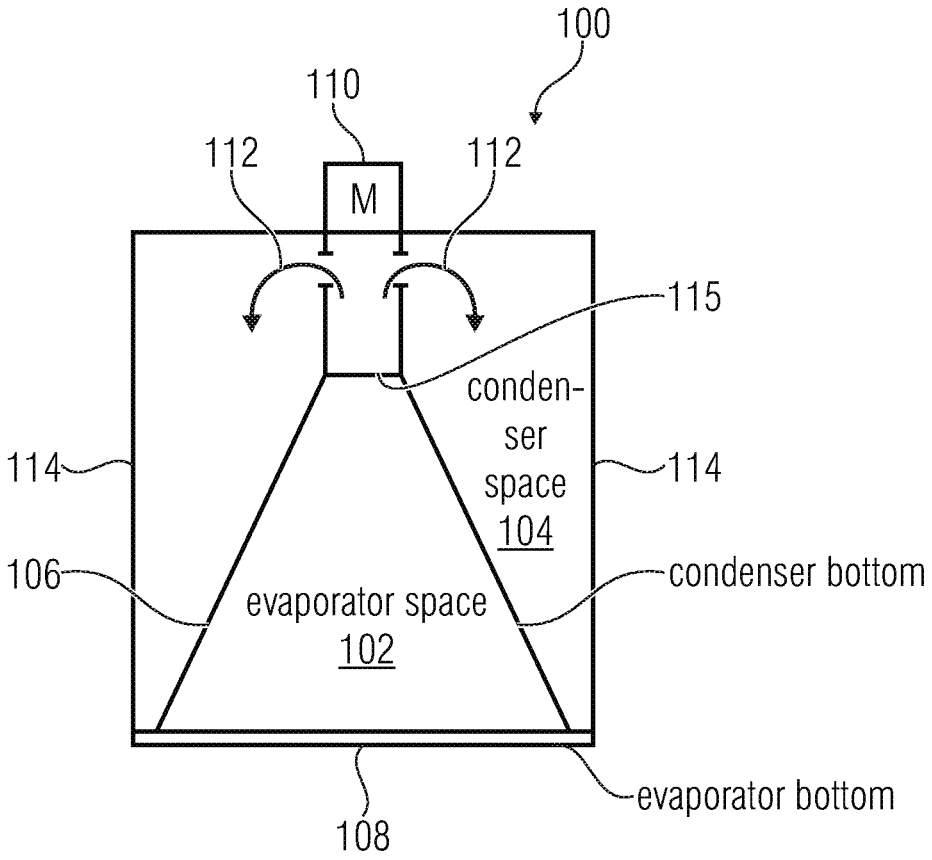
FIG. 1 shows a heat pump with an entangled arrangement.

FIG. 1 shows a heat pump 100 with an evaporator for evaporating working liquid in an evaporator space 102. The heat pump further includes a condenser for liquefying evaporated working liquid in a condenser space 104 that is limited by a condenser bottom 106. As is shown in FIG. 1, which may be seen as a sectional view or a side view, the evaporator space 102 is at least partially surrounded by the condenser space 104. Furthermore, the evaporator space 102 is separated from the condenser space 104 by the condenser bottom 106. In addition, the condenser bottom is connected to an evaporator bottom 108 in order to define the evaporator space 102. In one implementation, a compressor 110 is provided on the top side at the evaporator space 102 or at any other location, which is not described in more detail in FIG. 1, however, which is configured in principle to compress evaporated working liquid and to guide the same into the condenser space 104 as compressed vapor 112. The condenser space is further limited towards the outside by a condenser wall 114. Same as the condenser bottom 106, the condenser wall 114 is fixed to the evaporator bottom 108. In particular, the dimensioning of the condenser bottom 106 in the area that forms the interface to the evaporator bottom 108 is such that the condenser bottom is fully surrounded by the condenser space wall 114 in the embodiment shown in FIG. 1. This means that the condenser space, as is shown in FIG. 1, extends to the evaporator bottom and that the evaporator space at the same time extends very far upwards, typically through almost the entire condenser space 104.

This "entangled" or interlocking arrangement of the condenser and the evaporator, characterized in that the condenser bottom is connected to the evaporator bottom, provides a particularly high efficiency of a heat pump and therefore allows a particularly compact design of a heat pump. Regarding the size, the dimensioning of the heat pump, e.g. in a cylindrical shape, is such that the condenser wall 114 represents a cylinder with a diameter of between 30 and 90 cm and a height of between 40 and 100 cm. However, the dimensioning may be chosen according to the performance class of the heat pump, but advantageously in the above dimensions. This results in a very compact design which may be manufactured easily and cheaply since the number of interfaces, especially for the evaporator space that is almost at vacuum, may be reduced easily if the evaporator bottom is designed according to embodiments of the present invention in such a way that it includes all liquid inlets and outlets and that liquid inlets and outlets are therefore not necessary from the side or from above.

It should also be noted that the operating direction of the heat pump is such as is shown in FIG. 1. This means that the evaporator bottom defines the lower portion of the heat pump during operation, excepting connecting lines to other heat pumps or to corresponding pump units. This means that during operation the vapor generated in the evaporator space rises and is deflected by the motor and fed into the condenser space from top to bottom, and that the condenser liquid is guided from bottom to top and then provided into the condenser space from the top and then flows in the condenser space from top to bottom, e.g. through single droplets or small liquid streams, in order to react with the compressed vapor, advantageously fed cross-wise, for the purpose of condensation.

The "entangled" arrangement in which the evaporator is almost fully or fully arranged within the condenser enables a very efficient implementation of the heat pump with an optimal use of space. Since the condenser space extends to the evaporator bottom, the condenser space is formed within the entire "height" of the heat pump or at least within a significant portion of the heat pump. At the same time, however, the evaporator space is also as large as possible because it also extends almost over the entire height of the heat pump. Through the entangled arrangement, in contrast to an arrangement in which the evaporator is arranged below the condenser, the space is used in a most efficient manner. On the one hand, this enables a particularly efficient operation of the heat pump, and on the other hand, a particularly space-efficient and compact design, since both the evaporator and the liquefier extend across the entire height. This reduces the "thickness" of the evaporator space and also of the liquefier space. However, it has been found that reducing the "thickness" of the evaporator space tapering inside of the condenser is unproblematic since the main evaporation takes place in the lower area, where the evaporator space fills almost the entire volume available. On the other hand, the reduction of the thickness of the condenser space is not critical, especially in the lower area, i.e. where the evaporator space fills almost the entire available space, because the main condensation takes place at the top, i.e. where the evaporator space is already relatively thin, leaving sufficient space for the condenser space. The entangled arrangement is therefore ideal in that each functional space is given the large volume where said functional space needs the large volume. The evaporator space has the large volume at the bottom, whereas the condenser space has the large volume at the top. Nevertheless, even the corresponding small volume which remains where the other functional space has the large volume for the respective functional space contributes to an increased efficiency compared to a heat pump in which the two functional elements are arranged one above the other, as is the case in WO 2014072239 A1, for example.

In embodiments, the compressor is arranged at the top side of the condenser space such that the compressed vapor is deflected through the compressor on the one hand and is at the same time fed into an edge gap of the condenser space. This achieves condensation with particularly high efficiency since this achieves a cross-flow direction of the vapor with respect to a descending condensation liquid. This condensation with a cross-flow is particularly effective in the upper area, where the evaporator space is large, and in the lower area, where the condenser space is small in favor of the evaporator space, it no longer requires a particularly large area to still allow condensation of vapor particles that have penetrated up to this area.

An evaporator bottom that is connected to the condenser bottom is advantageously configured in such a way that it accommodates the condenser inlet and condenser outlet as well as the evaporator inlet and the evaporator outlet, wherein passages for sensors may also be provided in the evaporator or in the condenser. This makes it possible that lines are not necessary for the condenser inlet and the condenser outlet through the evaporator, which is almost under vacuum. This makes the entire heat pump less prone to failure since any passage through the evaporator would be a possibility for leakage. For this purpose, the condenser bottom is provided with a respective recess at locations where condenser inlets/outlets are located so that no condenser inlets/outlets run in the evaporator space defined by the condenser bottom.

The condenser space is limited by a condenser wall that is also attachable to the evaporator bottom. Thus, the evaporator bottom has an interface both for the condenser wall and for the condenser bottom and additionally has all liquid feeds both for the evaporator and the condenser.

In certain implementations, the evaporator bottom is configured to comprise connecting ports for the individual feeds, having a cross-section that differs from a cross-section of the opening on the other side of the evaporator bottom. The shape of the individual connecting ports is then configured such that the shape, or cross-sectional shape, changes across the length of the connecting port, however, the pipe diameter, which is important for the flow speed, remains approximately the same within a tolerance of ±10%. This prevents water flowing through the connection port from starting to cavitate. Through the good flow conditions obtained through shaping the connecting ports, it is ensured that the corresponding pipes/lines may be as short as possible, which in turn contributes to a compact design of the entire heat pump.

In a special implementation of the evaporator bottom, a condenser inlet is divided into a two-part or multi-part flow almost in the form of "spectacles". This makes it possible to feed the condenser liquid into the condenser at its upper portion at two or more points simultaneously. This results in a strong and, at the same time, particularly uniform condenser flow from top to bottom, which enables highly efficient condensation of the vapor that is also introduced into the condenser from above.

Another smaller-dimensioned feed for condenser water may be also provided in the evaporator bottom in order to connect a hose that provides cooling liquid to the compressor motor of the heat pump, wherein it is not the cold liquid provided to the evaporator that is used for cooling but the warmer liquid provided to the condenser which, however, is still cool enough to cool the motor of the heat pump in typical operating situations.

The evaporator bottom is characterized by its combination functionality. On the one hand, it ensures that condenser inlet lines do not have to be passed through the evaporator, which is under very low pressure. On the other hand, it represents an interface to the outside, advantageously having a circular shape since a circular shape leaves as much evaporator surface as possible. All inlet lines and outlet lines lead through an evaporator floor and from there to either the evaporator space or the condenser space. Manufacturing the evaporator bottom using plastic injection molding is particular advantageous since the advantageous, relatively complex shapes of the inlet/outlet ports may be easily and inexpensively carried out using plastic injection molding. On the other hand, due to the design of the evaporator bottom as an well-accessible component, it is easily possible to produce the evaporator bottom with sufficient structural stability, so that it may easily withstand the low evaporator pressure in particular.

In the present invention, the same reference numerals refer to identical or similar elements, wherein, if they come up again, not all the reference numerals are repeated in all of the drawings.

Figure 2:
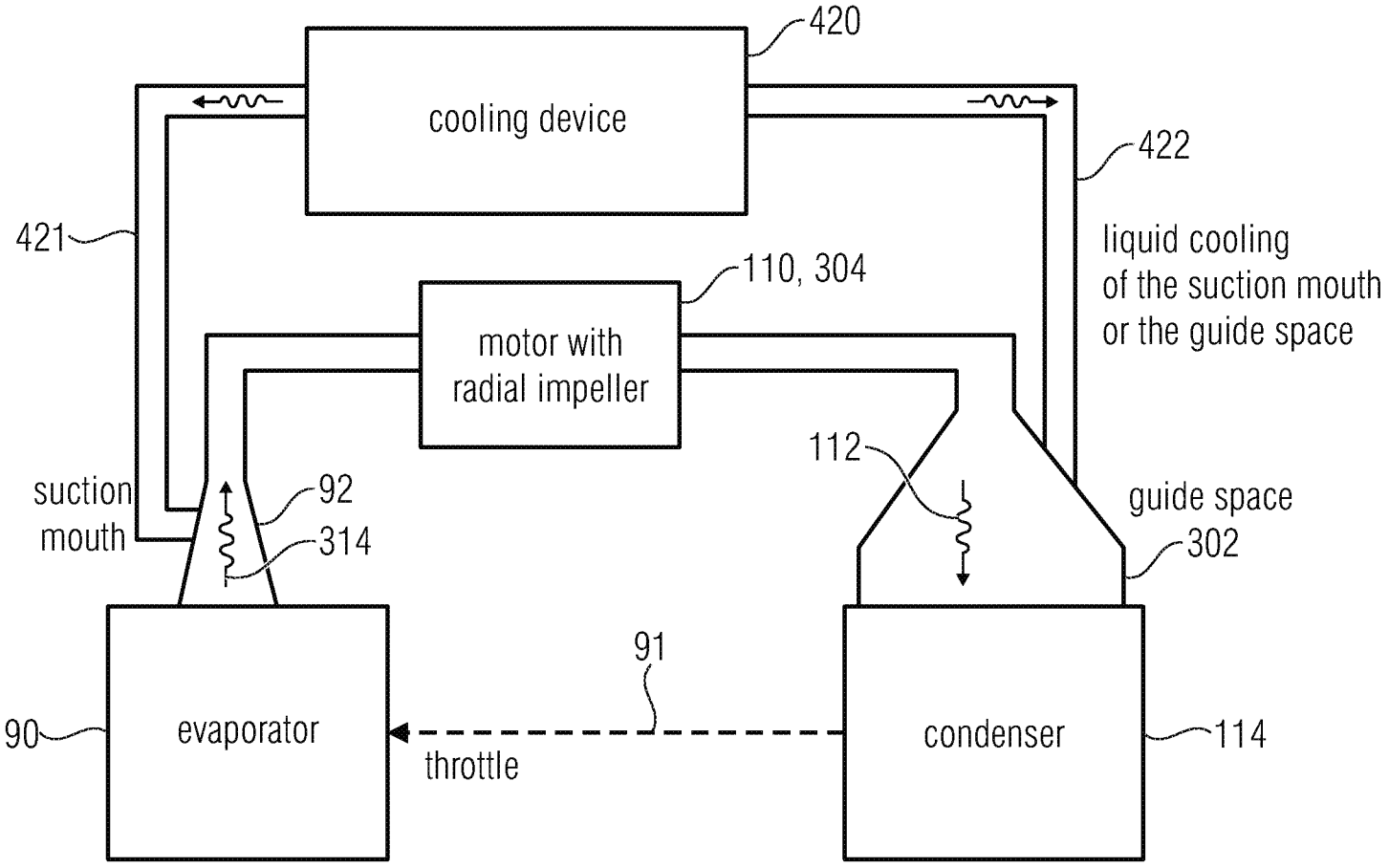
FIG. 2 shows an embodiment of the heat pump with a cooling device for cooling the guide space or the suction mouth.

FIG. 2 shows a heal pump according to the present invention which is either, as is advantageous, implemented in connection with the entangled arrangement described with respect to FIG. 1, but which may alternatively be implemented in an arrangement other than the entangled arrangement, as is schematically illustrated in FIG. 2.

The heat pump includes an evaporator 90 for evaporating working liquid. In addition, the heat pump includes a condenser or liquefier 114 for condensing evaporated and compressed working liquid.

The heat pump further includes a compressor motor having a radial impeller 110, 304 coupled to a suction mouth 92 to convey working vapor evaporated in the evaporator 90 through the suction mouth. In addition, the heat pump includes a guide space 302 arranged to guide working vapor conveyed by the radial impeller into the condenser 114. The working vapor evaporated in the evaporator 90 is schematically indicated with 314, and the working vapor 112 conveyed into the guide space and arriving in a compressed manner in the condenser 114 is schematically illustrated at 112.

According to the invention, the heat pump includes a cooling device 420 configured to cool the guide space 302 or the suction mouth 92 or the guide space 302 and the suction mouth 92 with a liquid. To this end, the cooling device 420 includes a liquid line 421 to the suction mouth 92 and/or a liquid line 422 to the guide space 302. Alternatively, only a single liquid line may be present to supply the guide space and the suction mouth. e.g., sequentially one after the another with cooling liquid. The cooling device is further configured to guide the liquid advantageously via lines 421, 422 or sequentially via one line to an outside of the guide space 302 or of the suction mouth 92, wherein the outside is not in contact with the working vapor 314, 112, whereas the inside of the guide space 302 or of the suction mouth 92 is in contact with this working vapor 314 and 112, respectively.

Preferably, water is used as the working liquid and in particular condenser water, i.e. a working liquid that is the same as the working liquid of the heat pump. Thus, the vapor of the liquid is the same vapor as the working medium vapor 314, 112 so that an open concept is obtained. Alternatively, a closed concept using a cooling liquid may be employed, where the cooling liquid is treated separately from the working liquid. Then, the cooling device 120 would be configured to have a return flow line of the cooling liquid, wherein the returned heated cooling liquid is to be cooled separately in order to then provide a cooled cooling liquid to the guide space or the suction mouth. However, an open guide space/suction mouth cooling is advantageous due to the simplicity of the design.

Figure 3:
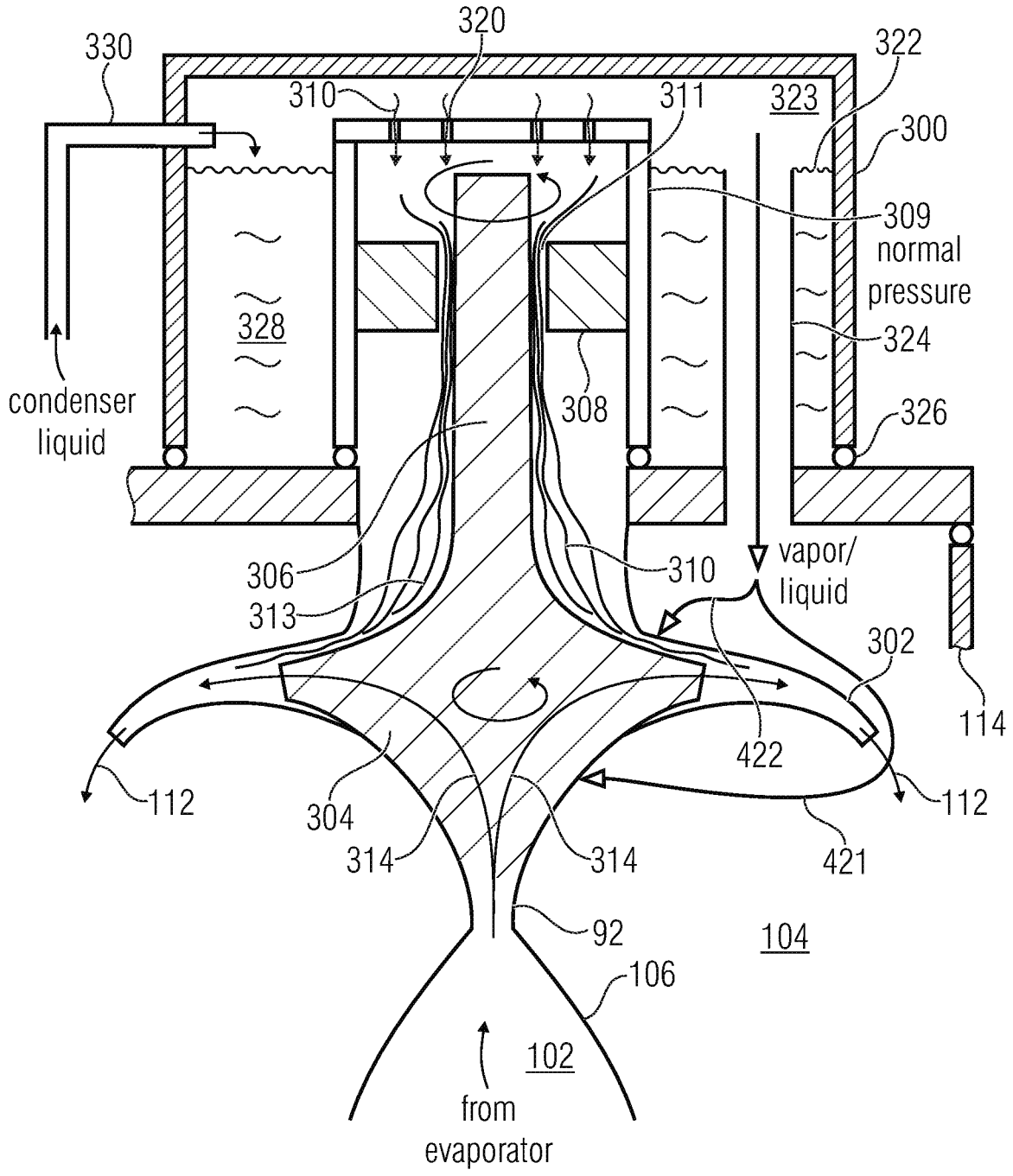
FIG. 3 shows a schematic illustration of a heat pump with convective shaft cooling on the one side and motor cooling on the other side.

FIG. 3 shows a heat pump with a condenser having a condenser housing 114, including a condenser space 104. Furthermore, the compressor motor is attached, which is schematically illustrated in FIG. 4 by the stator 308. This compressor motor is attached to the condenser housing 114, which is not shown in FIG. 3, and includes the stator and a rotor 306, wherein the rotor 306 comprises a motor shaft having attached thereto a radial impeller 304 that extends into an evaporator zone. Furthermore, the heat pump includes a guide space 302 configured to receive vapor compressed by the radial impeller and to guide the same into the condenser, as is schematically illustrated at 112.

The motor further includes a motor housing 300 surrounding the compressor motor and advantageously configured to maintain a pressure that is at least the same as the pressure in the condenser. Alternatively, the motor housing is configured to maintain a pressure that is higher than a mean pressure of the evaporator and the condenser, or that is higher than the pressure in the further gap 313 between the radial impeller and the guide space 302, or that is higher than or the same as the pressure in the condenser. The motor housing is configured such that a pressure drop occurs from the motor housing along the motor shaft towards the guide space, through which a working vapor is pulled through the motor gap and the further gap past the motor shaft in order to cool the shaft.

The area in the motor housing with the needed pressure is illustrated in FIG. 3 at 312. In addition, a vapor feed 310 is configured to provide vapor in the motor housing 300 to a motor gap 311 present between the stator 308 and the shaft 306. In addition, the motor includes a further gap 313 extending from the motor gap 311 along the radial impeller to the guide space 302.

In the inventive arrangement, there is a relatively high pressure $p_3$ in the condenser. On the other hand, there is a medium pressure $p_2$ in the guide path or guide space 302. Besides the evaporator, the lowest pressure is behind the radial impeller, where the radial impeller is fixed to the moto shaft. i.e. in the further gap 313. There is a pressure $p_4$ in the motor housing 300 that is either the same as the pressure $p_3$ or larger than the pressure $p_3$. Through this, there is a pressure gradient from the motor housing to the end of the further gap. This pressure gradient causes a vapor flow through the vapor feed into the motor gap and the further gap up to the guide path 302. This vapor flow takes working vapor from the motor housing past the motor shaft into the condenser. This vapor flow provides a convective shaft cooling of the motor shaft through the motor gap 311 and the further gap 313 that connects to the motor gap 311. Thus, the impeller sucks vapor downwards past the motor shaft. This vapor is drawn into the motor gap via the vapor feed, which is typically implemented as specially implemented drill holes.

At this point, it should be generally pointed out that the two aspects of convective shaft cooling on the one hand and motor cooling on the other hand are also used separately. For example, a motor cooling without a special separate convective shaft cooling already leads to a considerably increased operational reliability. Furthermore, a convective motor shaft cooling without the additional motor cooling also leads to an increased operational reliability of the heat pump. However, as shown in FIG. 3 below, the two aspects may be combined in a particularly advantageous way in order to implement both the convective shaft cooling and the motor cooling with a particularly advantageous construction of the motor housing and the compressor motor, wherein, in another embodiment, they may be supplemented by a special ball bearing cooling respectively or mutually.

FIG. 3 shows an embodiment with the combined use of a convective shaft cooling and a motor cooling, wherein, in the embodiment shown in FIG. 3, the evaporator zone is shown at 102. The evaporator zone is separated from the condenser zone, i.e. from the condenser area 104, by the condenser bottom 106. A working vapor, which is schematically illustrated at 314, is sucked in by the rotating radial impeller 304, which is shown schematically and in section, and "pressed" into the guide path 302. In the embodiment shown in FIG. 3, the guide path 302 is configured such that its cross-section is slightly enlarged towards the outside so that the kinetic energy still present in the working vapor may be converted into pressure without the flow being released from the wall and without losses occurring through turbulences. Through the radial flow towards the outside, the flow cross-section is continuously increased as long as the radius grows faster than the speed with which the upper and lower parts of the guide space come towards each other. This results in a further vapor compression. The first "stage" of the vapor compression already takes place through the rotation of the radial impeller and the radial impeller "sucking in" the vapor. When the radial impeller feeds the vapor into the input of the guide path, i.e. where the radial impeller "ends" towards the upside, the pre-compressed vapor encounters a vapor jam, so to speak. This leads to a further vapor compression so that the compressed and therefore heated vapor 112 finally flows into the condenser.

FIG. 3 further shows the vapor feed openings 320, which are configured in a schematically illustrated motor wall 309 in FIG. 3. As shown in FIG. 3, this motor wall 309 has drilled holes for the vapor feed openings 320 in the upper area, however, these drilled holes may be configured at any location at which vapor may enter into the motor gap 311 and therefore also into the further motor gap 313. The vapor flow 310 caused in such a way then leads to the desired effect of the convective wave cooling.

The embodiment shown in FIG. 3 also includes a working medium inlet line 330 for the implementation of the motor cooling, configured to guide a liquid working medium from the condenser to the motor wall in order to cool the motor. Furthermore, the motor housing is configured to keep a maximum liquid level 322 of liquid working medium during operation of the heat pump. In addition, the motor housing 300 is also configured to form a vapor space 323 above the maximum level. Furthermore, the motor housing has means to guide a liquid working medium above the maximum level into the condenser 104. For example, this implementation is configured in the embodiment shown in FIG. 3 by means of a flat channel-shaped overflow 324 which forms the vapor discharge and is arranged at any location in the upper condenser wall and has a length that defines the maximum level 322. If too much working liquid is introduced into the motor housing, i.e. the liquid area 328, by the condenser liquid feed line 330, the liquid working medium flows through the overflow 324 into the condenser volume. In addition, the overflow also provides a pressure compensation between the motor housing and in particular the vapor space 323 of the motor housing and the condenser interior space 104 in the passive arrangement shown in FIG. 3, which may alternatively also be a tube with a corresponding length, for example. Thus, the pressure in the vapor space 323 of the motor housing is almost always constant or at most only slightly larger than the pressure in the condenser due to a pressure loss along the overflow. Thus, the boiling point of the liquid 328 in the motor housing will be similar to the boiling point in the condenser housing. Through this, a heating of the motor wall 309 through a heat loss generated in the motor leads to the fact that bubble boiling occurs in the liquid volume 328, which will be explained later.

FIG. 3 also schematically shows various seals at reference numeral 326 and at similar locations between the motor housing and the condenser housing on the one side or also between the motor wall 309 and the condenser housing 114 on the other side. These seals are to symbolize that there is a liquid-tight and pressure-tight connection.

The motor housing defines a separate space which, however, represents almost the same pressure area as the condenser. Due to the motor being heated and the energy therefore emitted at the motor wall 309, this supports bubble boiling in the liquid volume 328, which in turn results in a particularly efficient distribution of the working liquid in the volume 328 and therefore a particularly good cooling with a small volume of cooling liquid. It also ensures that the cooling is carried out with the working liquid that is at the most favorable temperature, i.e. the hottest temperature in the heat pump. This ensures that all condensation problems, which occur on cold surfaces, are eliminated for the motor wall and the motor shaft and the areas in the motor gap 311 and the further gap 313. In the embodiment shown in FIG. 3, the working medium vapor 310 used for the convective shaft cooling is a vapor that is otherwise in the vapor space 323 of the motor housing. Like the liquid 328, this vapor also has the ideal (warm) temperature. Furthermore, the overflow 324 ensures through the bubble boiling caused by the motor cooling, or the motor wall 309, that the pressure in the area 323 cannot rise above the condenser pressure. Furthermore, the heat energy due to the motor cooling is dissipated by the vapor discharge. Therefore, the convective shaft cooling will constantly work in the same way. If the pressure were to increase too much, too much of the working medium vapor could be forced through the motor gap 311 and the other gap 313.

The drilled holes 320 for the vapor feed lines supply will typically be configured in an array that can be regularly or irregularly arranged. Individual drilled holes have a diameter of no more than 5 mm and may be at a minimum size of about 1 mm.

FIG. 3 further shows the liquid lines 421 and 422 to the guide space 302 and the suction mouth 92, respectively, via which the radial impeller 304 sucks in vapor from the evaporator 102 and outputs it into the guide space 302. The schematic lines 421, 422 are configured to guide the liquid directly onto the surface of the corresponding elements. As will be illustrated with reference to FIG. 10 and FIG. 11, these lines may also be implemented as a single line such that a sequential liquid supply of the top side, the suction mouth and the bottom side of the guide space 302 is carried out.

In particular, the lines 422 may be implemented as channels that are configured in a fixed manner or as flexible lines such as hose elements.

Figure 4A:
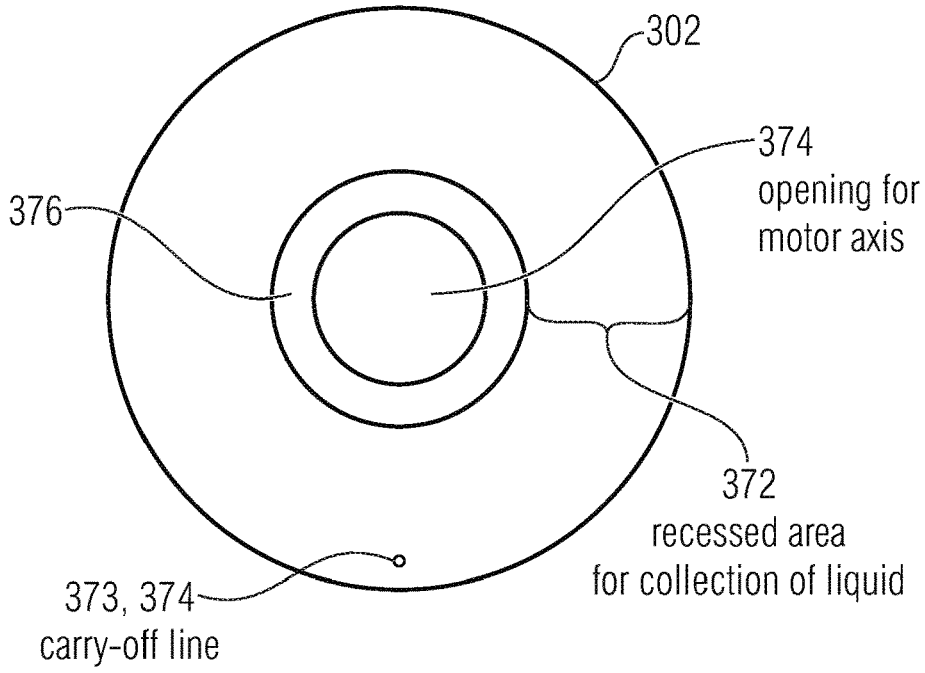
FIG. 4*a* shows a top view onto a guide space with a recessed area.
Figure 10:
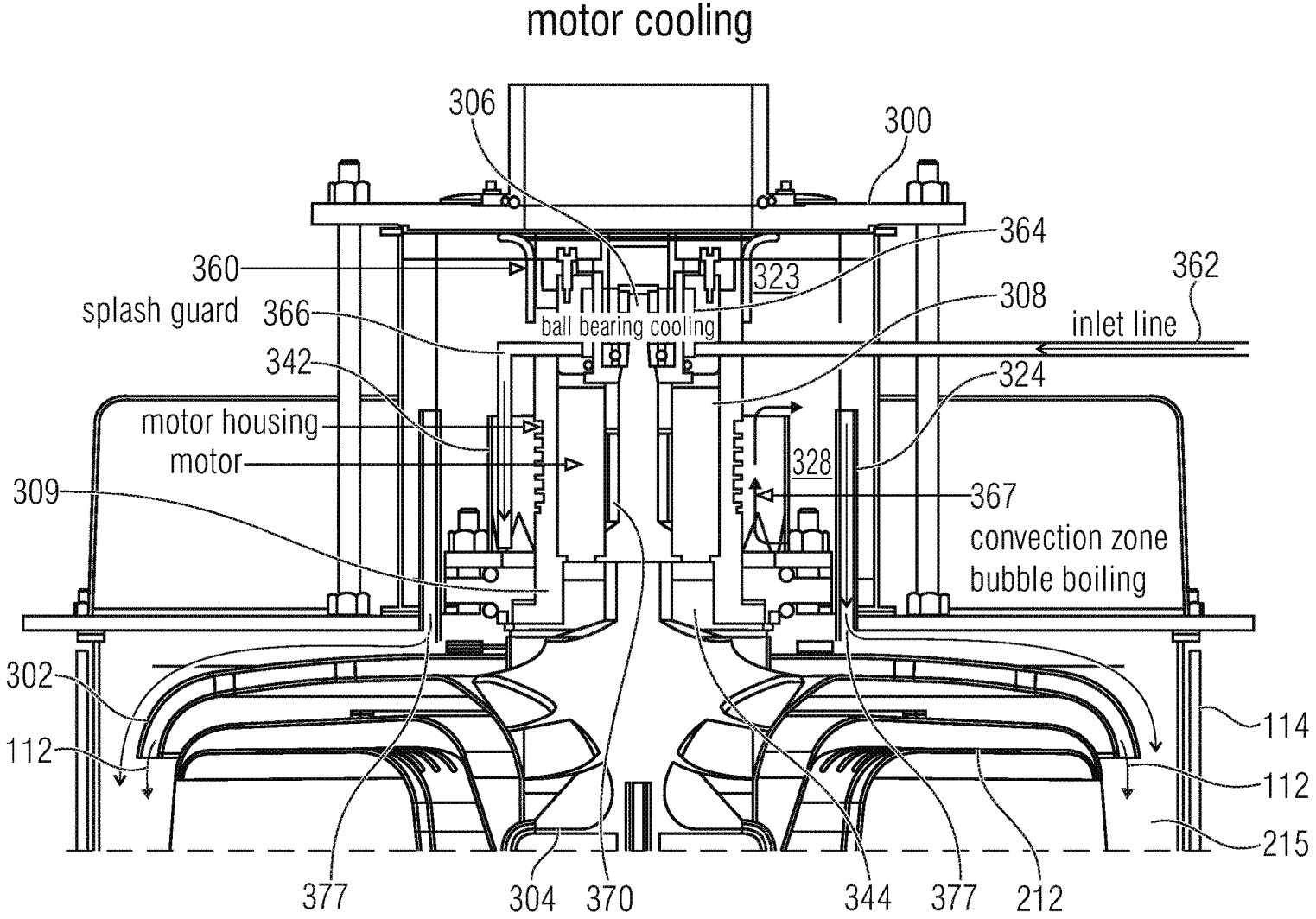
FIG. 10 shows a heat pump according to an embodiment, having a conventional shaft cooling according to the first aspect and a motor cooling according to the second aspect, wherein particular emphasis is placed on the motor cooling.
Figure 11:
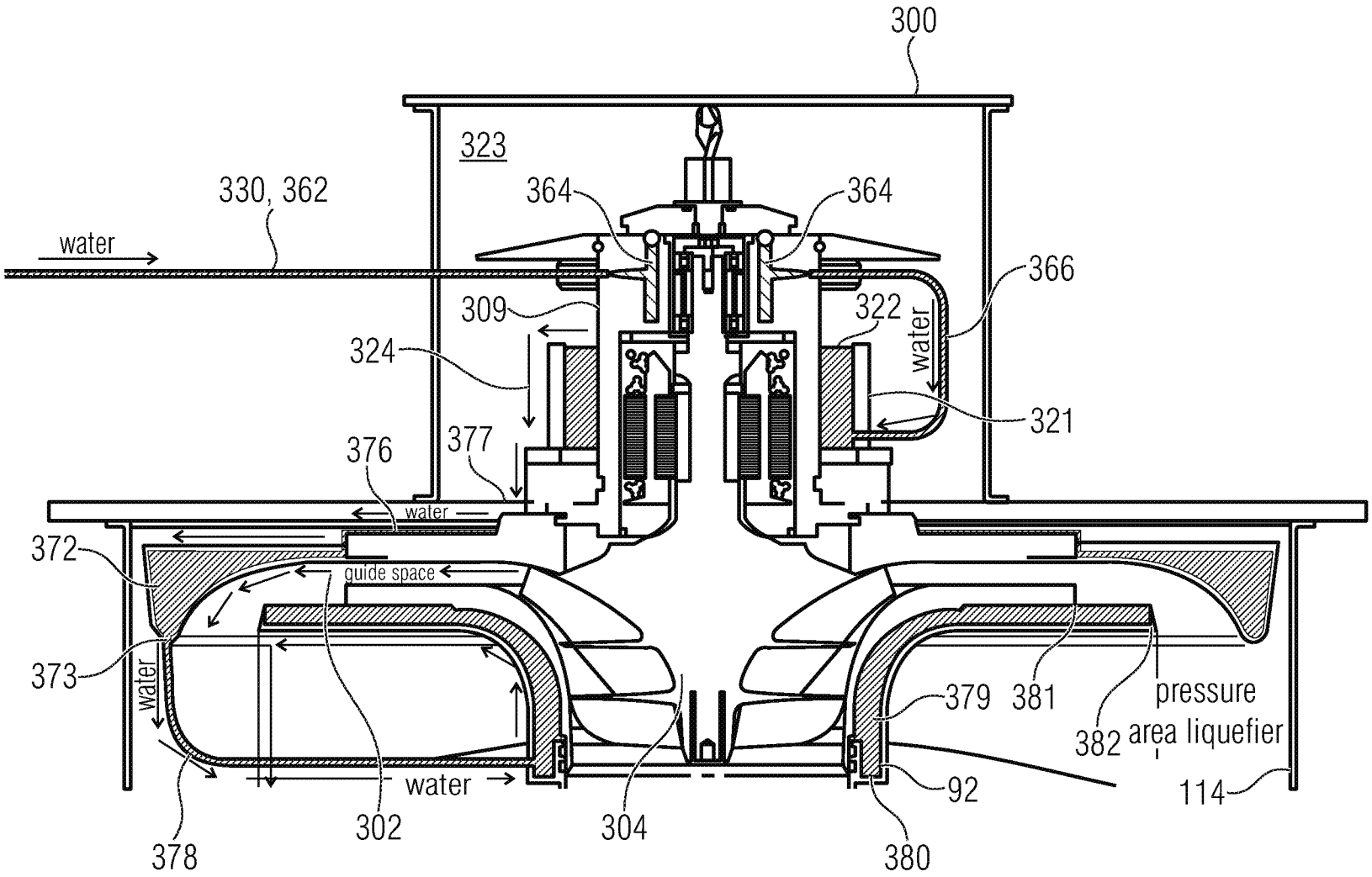
FIG. 11 shows an embodiment of the present invention with a combined ball bearing cooling, motor cooling, guide space cooling and suction mouth cooling.

FIG. 4*a* shows a top view of the guide space 302 of FIG. 3 or of the guide space 302 of FIG. 10 or of FIG. 11. In particular, the guide space 302 includes in the top view from above an opening 374 for accommodating the motor axis, the axis extending through this opening 374 from the motor into the guide space in order to there support the radio antenna 304 that is put into rotation through the rotation of the motor axis.

In addition, the guide space includes a recessed area 372 that is configured to collect liquid and that is illustrated in its cross-section in FIG. 11. In particular, for manufacturing the recessed area, the upper end of the guide space 302, as is exemplary shown in FIG. 3, is provided with an upwardly projecting edge so that liquid may collect in the recessed area, which extends across the entire guide space, and the liquid "stagnates" there, so to speak, e.g., the liquid having been provided via a liquid feed line 422, which is exemplarily configured in FIG. 11 as the passage opening 372 from the motor space, and which is then continued via a flow area 376 through which the liquid flows into the recessed area 372. The recessed area comprises a drainage line 373, or a connecting area 373 having connected thereto a hose-like drainage line 378, which is also shown in FIG. 11.

Figure 4B:
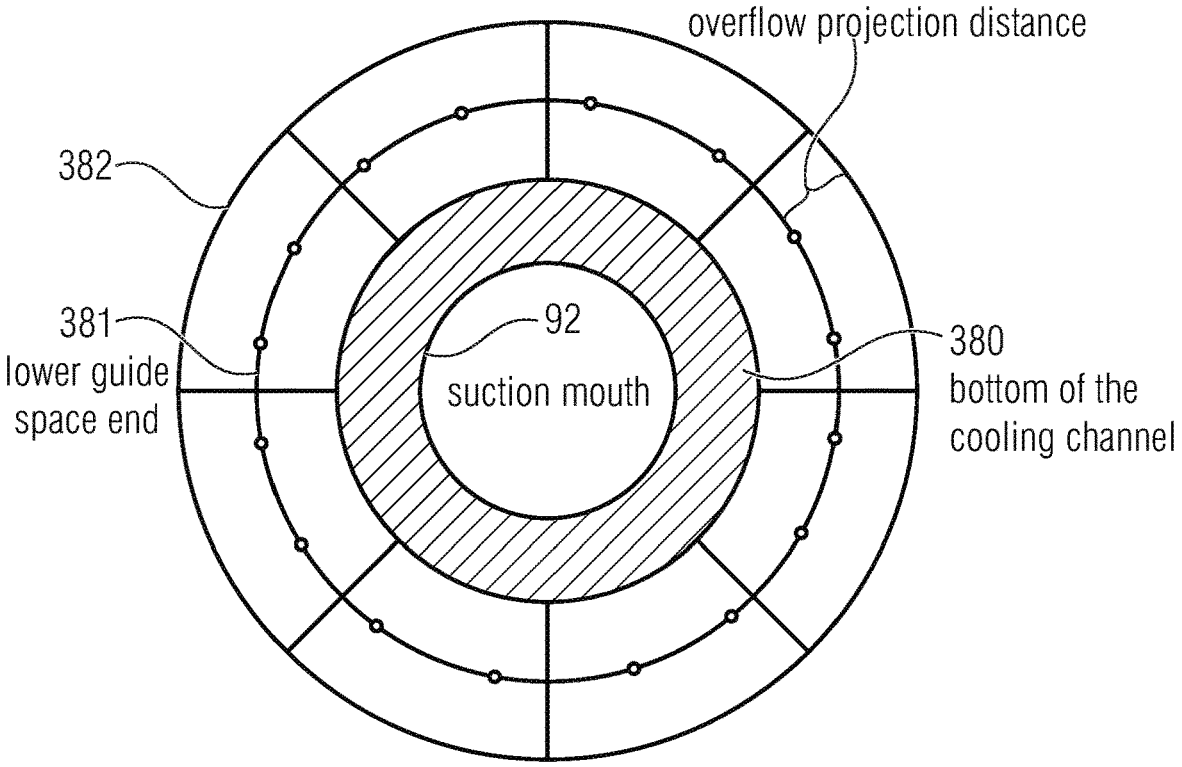
FIG. 4*b* shows a view from below the suction mouth and the guide space with the cooling channel and the cooling liquid overflow.

FIG. 4*b* shows a view from below the combination element of the suction mouth 92 and the guide space 302. In particular, the suction mouth opening is shown in the middle of FIG. 4*b*. Next to the suction mouth opening, there is the bottom 380 of a cooling channel 379 (shown in FIG. 11) into which the cooling liquid is fed via the drainage line 378, which is shown in FIG. 11. Due to the height different of the reservoir in the recessed area 372, the cooling liquid in the cooling channel flows past the outside of the suction mouth 92 and the lower outside of the suction mouth 302. The end of the lower suction mouth 381 is shown in a dotted manner in FIG. 4*b*. This is to indicate that this line is not visible in the view from below since it is covered by the lower end 382 of the cooling channel. In particular, the overflow projection distance is formed between the line 381 and the line 382 in FIG. 4, indicating an open area of liquid that projects directly into the vapor channel and that is covered on its top side from the upper outside of the guide space 302.

The projection 382 is located at the end of the cooling channel, projecting far enough that a certain level is formed. Excessive working liquid runs over this projection downwards into the condenser, or in to the condenser volume.

It should be noted that FIG. 4*a* and FIG. 4*b* are not drawn to scale, but only schematically show an embodiment of the guide space 302, wherein, depending on the explanation, the term guide space designates in this application the guide space in the guide space housing or the housing of the guide space itself, i.e. the housing surrounding the vapor channel, as is illustrated as upper guide space housing in FIG. 4*a* and as lower guide space housing FIG. 4*b*.

Figure 6:
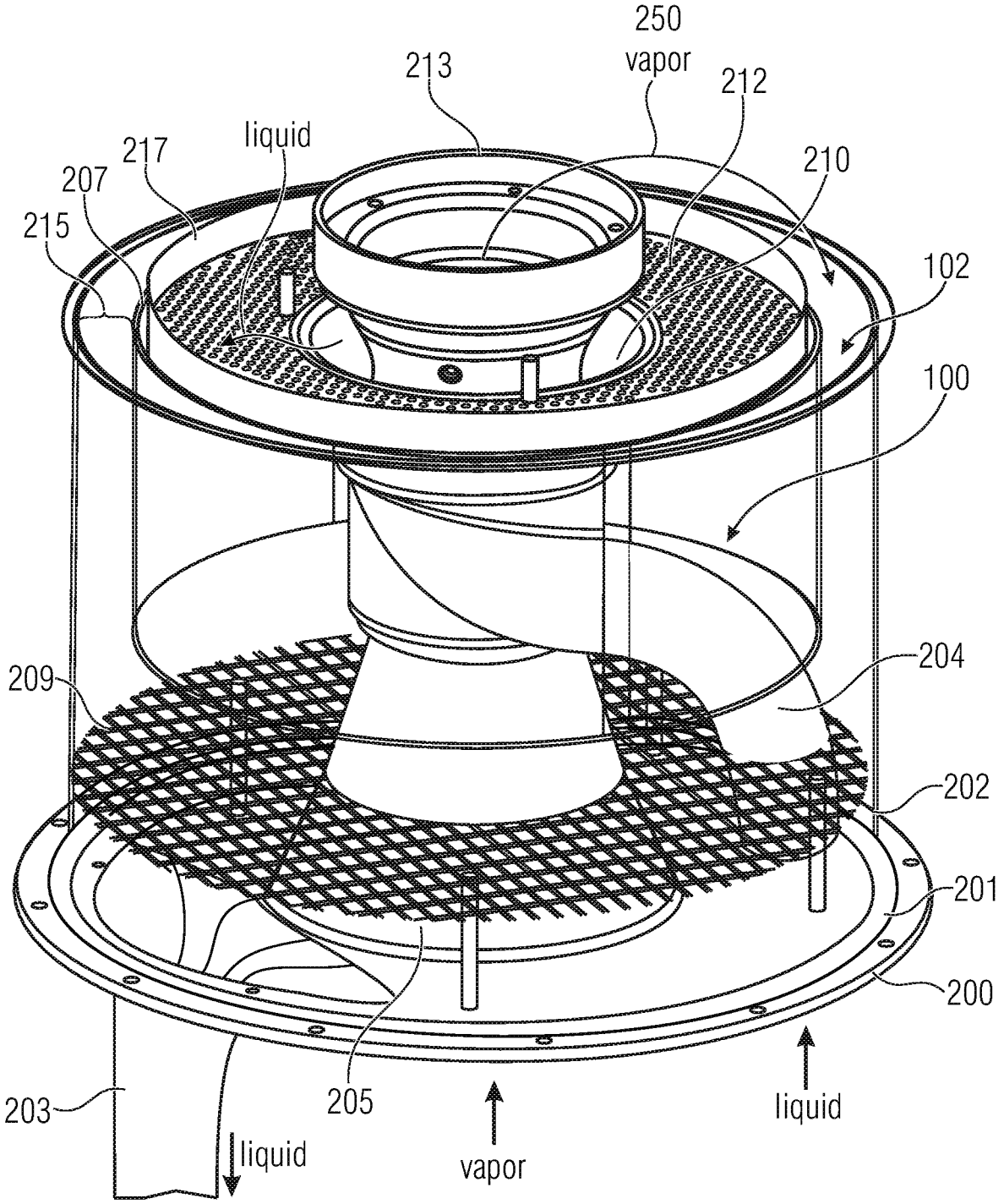
FIG 6 (PRIOR ART)
FIG. 6 shows a perspective illustration of a liquefier as is shown in WO 2014072239 A1.

FIG. 6 shows a liquefier, wherein the liquefier in FIG. 6 comprises a vapor introduction zone 102 that fully extends around the condensation zone 100. In particular, FIG. 6 illustrates a part of the liquefier comprising a liquefier bottom 200. A liquefier housing portion 202, which is drawn translucent for the sake of illustration in FIG. 6, however, which does not have to be translucent in its nature, but may be formed from plastic, die-cast aluminum or the like, is arranged on the liquefier bottom. The lateral housing part 202 rests on a sealing washer 201 in order to achieve a good seal with the bottom 200. Furthermore, the liquefier includes a liquid outlet line 203 and a liquid inlet line 204 as well as a vapor feed 205 centrally arranged in the liquefier and tapering from bottom to top in FIG. 6. It is to be noted that FIG. 6 illustrates the actually desired installation direction of a heat pump and of a liquefier of this heat pump, wherein the evaporator of a heat pump is arranged below the liquefier in this installation direction in FIG. 6. The condensation zone 100 is limited towards the outside by a basket-like limiting object 207 that, like the outer housing part 202, is drawn transparently and is normally configured to be basket-like.

In addition, a grid 209 is arranged, configured to support a filling body, which is not shown in FIG. 6. As can be seen from FIG. 6, the basket 207 extends downwards only to a certain point. The basket 207 is provided to be vapor-permeable in order to support filling bodies such as so-called Pall rings. These filling bodies are introduced into the condensation zone, but only within the basket 207 and not into the vapor introduction zone 102. However, the filling bodies are also introduced outside of the basket 207 at such a height that the height of the filling bodies extends either to the lower boundary of the basket 207 or slightly above.

The liquefier of FIG. 6 includes a working liquid provider that is particularly configured by the working liquid feed 204, which, as is shown in FIG. 6, is arranged wound around the vapor feed in the form of an ascending turn, by a liquid transport area 210 and by a liquid distribution element 212 advantageously configured as a perforated plate. In particular, the working liquid provider is therefore configured to provide the working liquid into the condensation zone.

In addition, a vapor provider is provided that, as is shown in FIG. 6, is advantageously composed on the funnel-shaped tapering feed area 205 and the upper vapor guide area 213. An antenna of a radial compressor is advantageously inserted into the vapor guide area 213, and the radial compression leads to the fact that the vapor is sucked from the lower side to the upper side through the feed 205 and is then deflected due to the radial compression by the radial impeller by 90 degrees towards the outside, so to speak, i.e. from a flow from the bottom to the top to a flow from the center to the outside in FIG. 6 with respect to the element 213.

What is not shown in FIG. 6 is a further deflector that deflects the already outwardly-deflected vapor again by 90 degrees in order to guide it from the top into the gap 215 that represents the beginning of the vapor introduction zone, so to speak, which laterally extends around the condensation zone. The vapor provider is therefore advantageously configured in an annular-shaped manner and is provided with an annular-shaped gap for feeding the vapor to be condensed, wherein the working liquid feed is configured within the annular-shaped gap.

Figure 7:
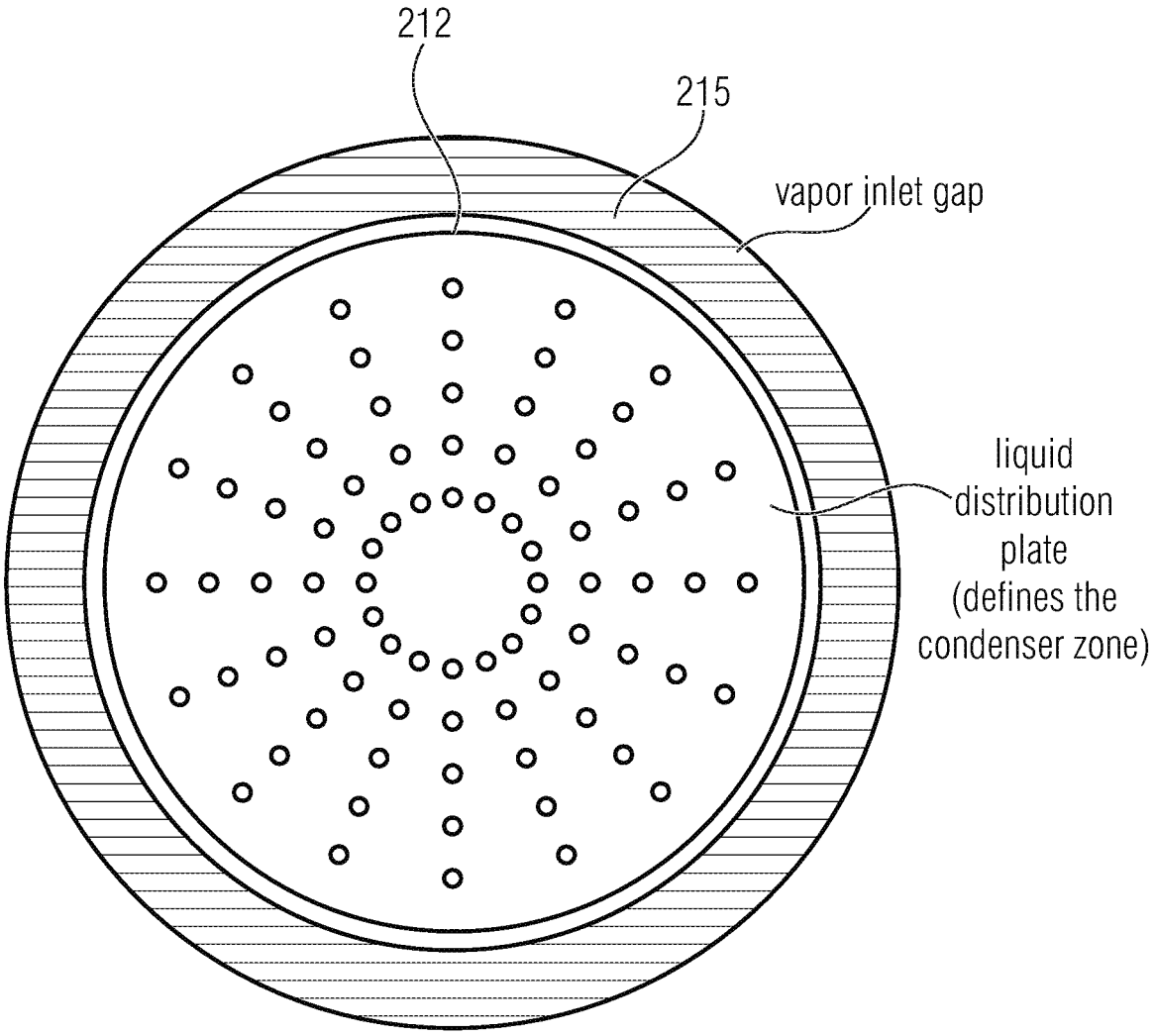
Fig. 7 (PRIOR ART)
FIG. 7 shows an illustration of the liquid distribution plate on the one hand and the vapor introduction zone with a vapor inlet gap on the other hand from WO 2014072239 A1.
Figures 8A, 8B:
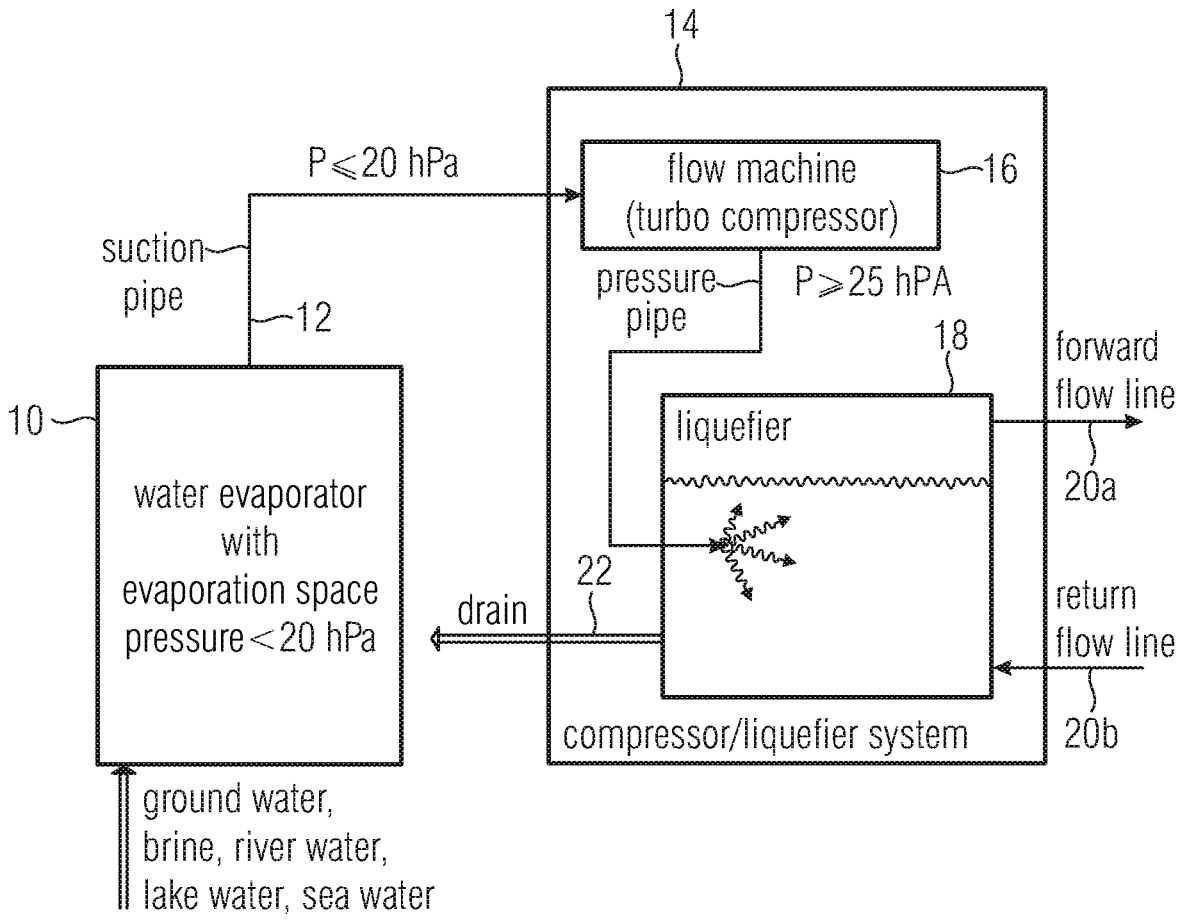
Fig. 8a (PRIOR ART)
FIG. 8*a* shows a schematic illustration of a known heat pump for evaporating water.
FIG. 8*b* shows a table for illustrating pressures and evaporation temperatures of water as a working liquid.

For the sake of illustration, reference is made to FIG. 7. FIG. 7 shows a view of the "cover area" of the liquefier of FIG. 6 from below. In particular, the perforated plate 212 acting as the liquid distribution element is schematically illustrated from below. The vapor inlet gap 215 is drawn schematically, and FIG. 7 shows that the vapor inlet gap is only configured to be annular-shaped in such a way that vapor to be condensed is not fed into the condensation zone directly from above or directly from below, but only laterally around the same. Thus, only liquid flows through the holes of the distributor plate 212, but no vapor. The vapor is "sucked" into the condensation zone at the side due to the liquid that has passed through the perforated plate 212. The liquid distribution plate may be configured of metal, plastic or a similar material and may be implemented with different hole patterns. Furthermore, as is shown in FIG. 6, it is advantageous to provide a lateral boundary for a liquid flowing out of the element 210, this lateral boundary being designated with 217. This ensures that a liquid that exits the element 210 already with a swirl due to the wounded feed 204 and is distributed from the inside towards the outside on the liquid distributor does not splash over the edge into the vapor introduction zone if the liquid has not already dripped through the holes of the liquid distributor plate and has condensed with vapor beforehand.

Figure 5:
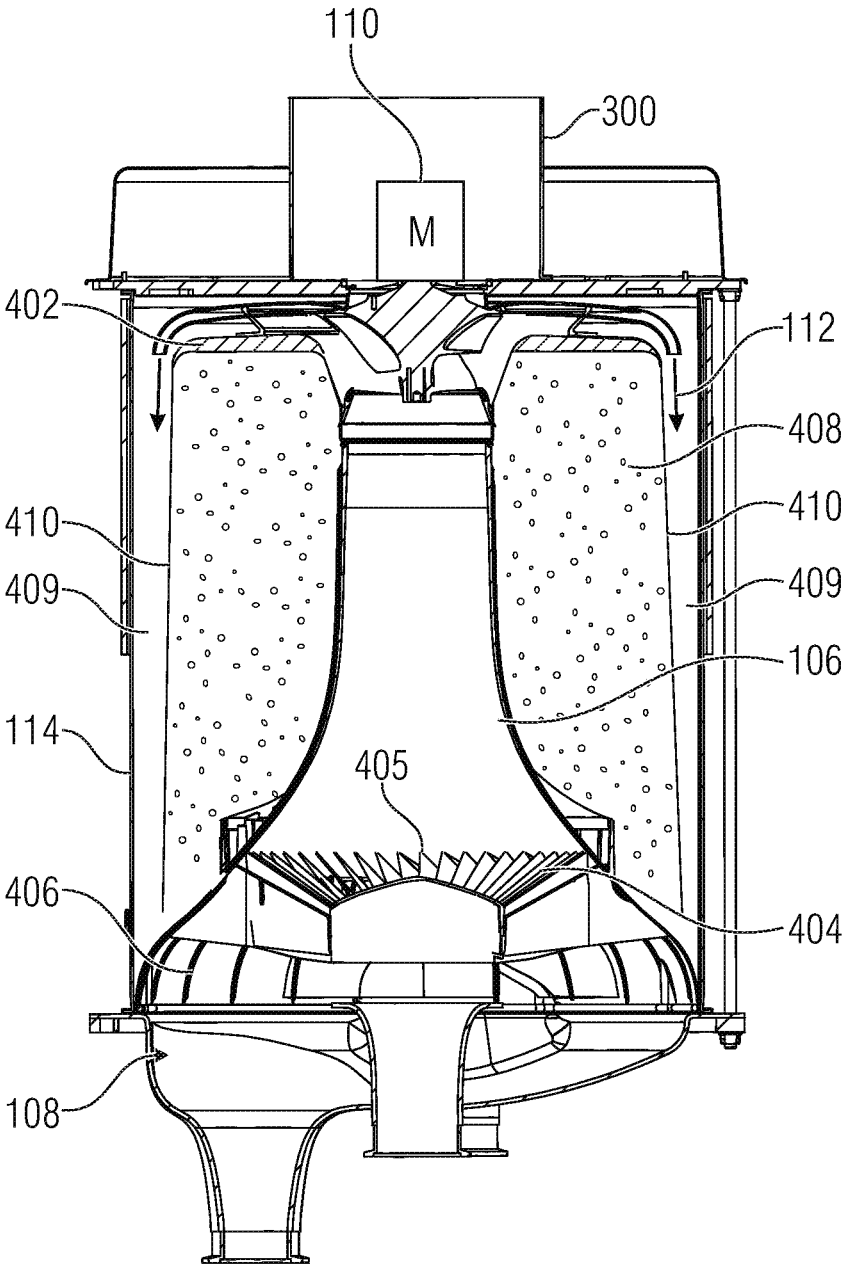
FIG. 5 shows a sectional view of a heat pump with an evaporator bottom and a condenser bottom according to the embodiment of FIG. 1.

FIG. 5 shows a complete heat pump in a sectional view, including both the evaporator bottom 108 and the condenser bottom 106. As shown in FIG. 5 or also in FIG. 1, the condenser bottom 106 has a tapering cross section from an inlet for the working liquid to be vaporized to a suction opening 115 coupled to the compressor, or the motor 110, where the advantageously used radial impeller of the motor sucks out the vapor generated in the evaporator space 102.

FIG. 5 shows a cross-section through the entire heat pump. In particular, a droplet separator 404 is arranged within the condenser bottom. This droplet separator includes individual blades 405. In order for the droplet separator to remain at its location, the blades are introduced into corresponding grooves 406, which are shown in FIG. 5. In the condenser bottom, these grooves are arranged in an area directed towards the evaporator bottom in the inside of the evaporator bottom. In addition, the condenser bottom further comprises different guiding features that may be configured as rods or tongues in order to hold hoses that are provided for guiding condenser water, for example, which are therefore plugged onto corresponding portions and that couple feed points of the condenser water feed. Depending on the implementation, this condenser water feed 402 may be configured such as is shown in FIG. 6 and FIG. 7 at the reference numerals 102, 207 to 250. Furthermore, the condenser advantageously comprises a condenser liquid distribution arrangement comprising two or more feed points. A first feed point is therefore connected to a first portion of a condenser inlet line. A second feed point is connected to a second portion of the condenser inlet line. If more feed points are present for the condenser liquid distribution unit, the condenser inlet line will be divided into further portions.

The upper area of the heat pump of FIG. 5 may therefore be configured in the same way as the upper area in FIG. 6, in such a way that the condenser water feed takes place via the perforated plate of FIG. 6 and FIG. 7, so that condenser water 408 is obtained which drips downwards and into which the working vapor 112 is introduced advantageously laterally so that the cross-flow condensation is obtained, enabling a particularly high efficiency. As is also illustrated in FIG. 6, the condensation zone may be provided with a (purely optional) filling, wherein the edge 207, which is also designated with 409, remains free of filing bodies or similar objects, in such a way that the working vapor 112 may not only enter into the condensation zone from the top but also from below and laterally. This is illustrated by the imaginary boundary line 410 in FIG. 5. In the embodiment shown in FIG. 5, however, the entire area of the condenser is configured with a separate condenser bottom 200 that is arranged above an evaporator bottom.

FIG. 10 shows an embodiment of a heat pump and in particular of a heat pump portion that shows the "upper" area of the heat pump, as is exemplarily illustrated in FIG. 5. In particular, the motor M 110 of FIG. 5 corresponds to the area surrounded by a motor wall 309 configured, in the cross-sectional illustration in FIG. 10, advantageously with cooling fins in the liquid area 328 on its outside in order to increase the surface area of the motor wall 309. Furthermore, the area of the motor housing 300 in FIG. 4 corresponds to the corresponding area 300 in FIG. 5. FIG. 10 further illustrates the radial impeller 304 in a more detailed cross section. The radial impeller 304 is attached at the motor shaft 306 in a fixing area that is fork-shaped in its cross section. A motor shaft 306 comprises a rotor 307 opposite to the stator 308. The rotor 307 includes permanent magnets, which are schematically illustrated in FIG. 10. The motor gap 311 extends between the rotor and the stator and ends in the further gap 313 that extends along the fixing area of the shaft 306, said fixing area being fork-shaped in its cross-section, up to the guide space 302, as is also illustrated at 346.

In addition, FIG. 10 illustrates an emergency bearing that does not support the shaft during normal operation. Instead, the shaft is supported by the bearing portion shown at 343. The emergency bearing 344 is only present in order to support the shaft and therefore the radial impeller in the case of damage so that the rapidly rotating radial impeller cannot cause major damage to the heat pump in the event of damage. FIG. 10 further shows different fixing elements such as bolts, nuts, etc., and various seals in the form of various O-rings. Furthermore, FIG. 10 shows an additional convection element 342, which will be discussed later with reference to FIG. 10.

FIG. 10 also shows a splash guard 360 in the vapor space above the maximum volume in the motor housing that is usually filled with a liquid working medium. This splash guard is configured to intercept liquid drops thrown into the vapor space during bubble boiling. Preferably, the vapor path 310 is configured such that it profits from the splash guard 360. i.e. such that only working medium vapor is sucked into the motor gap and the further gap due to the flow, but no liquid droplets due to boiling in the motor housing.

The heat pump with a convective shaft cooling advantageously has a vapor feed that is configured such that a vapor flow through the motor gap and the further gap does not pass through a bearing portion configured to support the motor shaft with respect to the stator. The bearing portion 343, including two ball bearings in the present case, is sealed from the motor gap, e.g. by O-rings 351. With this, as is illustrated by the path 310, the working vapor can only enter into an area within the motor wall 309 from the vapor feed, flow from there into a free space towards the bottom and reach along the rotor 307 through the motor gap 311 into the further gap 313. The advantage of this is that vapor does not flow around the ball bearings, so that a bearing lubrication remains in the sealed ball bearings and is not drawn out through the motor gap. Furthermore, this also ensures that the ball bearing is not moistened, but remains in the defined state during installation.

In another embodiment, the motor housing is attached on top of the condenser housing 114 in the operation position of the heat pumps so that the stator is located above the radial impeller and the vapor flow 310 extends through the motor gap and the further gap from top to bottom.

Furthermore, the heat pump includes the bearing portion 343 configured to support the motor shaft with respect to the stator. In addition, the bearing portion is arranged such that the rotor 307 and the stator 308 are arranged between the bearing portion and the radial impeller 304. This has the advantage that the bearing portion 343 may be arranged in the vapor area within the motor housing and that the rotor/stator, where the largest heat loss occurs, may be arranged underneath the maximum liquid level 322 (FIG. 3). This provides an ideal arrangement by means of which each area is in the medium that is best for the area to achieve the respective purpose, i.e. the motor cooling on the one hand and the convective shaft cooling on the other hand, and possibly a ball bearing cooling, which will be discussed with respect to FIG. 10.

The motor housing further includes the working medium inlet 330 in order to guide liquid working medium from the condenser to a wall of the compressor motor in order to cool the motor. FIG. 10 shows a special implementation of this working medium inlet 362 that corresponds to the inlet 330 of FIG. 3. This working medium inlet 362 extends into a closed volume 364 that represents a ball bearing cooling. A drainage exits from the ball bearing cooling, said drainage including a tube 366 that does not guide the working medium upwards to the volume of the working medium 328, as is shown in FIG. 3, but that guides the working medium on the lower side to the wall of the motor, i.e. to the element 309. In particular, the tube 366 is configured to be arranged within the convection element 342 that is arranged around the motor wall 309, but in a certain distance so that a volume of the liquid working medium is present within the convection element 342 and outside of the convection element 342 within the motor housing 300.

By means of bubble boiling due to the working medium in contact with the motor wall 309 in particular in the lower area where the fresh working medium inlet 366 ends, there is a convection zone 367 within the volume of working liquid 328. In particular, boiling bubbles are pulled from the bottom to the top through the bubble boiling. This leads to a continuous "stirring", wherein hot working liquid is brought from the bottom to the top. The energy due to the bubble boiling is then transferred into the vapor bubble that then lands in the vapor volume 323 above the liquid volume 328. The pressure arising there is immediately brought into the condenser through the overflow 324, the overflow continuation and the drain 342. This results in a permanent heat transfer from the motor to the condenser, which is mainly due to the transfer of vapor and not to the transfer of heated liquid.

This means that the heat, which is actually the waste heat from the motor, is advantageously transferred by the vapor discharge to exactly where it should go, namely into the condenser water to be heated. In this way, the entire motor heat is retained in the system, which is particularly advantageous for heat pump heating applications. However, the heat transfer from the motor to the condenser is also favorable for cooling applications of the heat pump since the condenser is typically coupled to an efficient heat dissipation. e.g. in the form of a heat exchanger or a direct heat dissipation in the area to be heated. This means that there is no need to provide a separate motor waste heat device, but the heat dissipation from the condenser to the outside, which already exists form the heat pump, is "used" to a certain extent by the motor cooling.

The motor housing is further configured to maintain the maximum level of the liquid working medium and to create the vapor space 323 above the level of the liquid working medium during operation of the heat pump. The vapor feed is further configured to communicate with the vapor space so that the vapor in the vapor space is guided through the motor gap and the further gap in FIG. 4 for the convective shaft cooling.

In the heat pump shown in FIG. 10, the drain is arranged as an overflow in the motor housing in order to guide the liquid working medium above the level into the condenser and to further provide a vapor path between the vapor space and the condenser. Preferably, the drain 324 is both, i.e. an overflow and a vapor path. However, these functionalities may be implemented by an alternative design of the overflow on the one hand and a vapor space on the other hand, using different elements.

In the embodiment shown in FIG. 10, the heat pump comprises a special ball bearing cooling, which is in particular configured such that the sealed volume 364 with the liquid working medium is configured around the bearing portion 343. The inlet 362 enters this volume and the volume has a drain 366 from the ball bearing cooling into the working medium volume for the motor cooling. With this, a separate ball bearing cooling is created, however, which extends around the outside of the ball bearing and not inside the bearing so that this ball bearing cooling provides efficient cooling but does not affect the lubrication filling of the bearing.

As is further shown in FIG. 10, the working medium inlet 362 includes in particular the line portion 366, which almost extends to the bottom of the motor housing 300, or to the floor of the liquid working medium 328 in the motor housing, or at least to an area underneath the maximum level in order to guide a liquid working medium in particular out of the ball bearing cooling and to provide the liquid working medium to the motor wall.

FIG. 10 further shows the convection element arranged in the working medium and spaced apart from the wall of the compressor motor 309 and that is more permeable for the liquid working medium in a lower area than in an upper area. In particular, in the embodiment shown in FIG. 10, the upper area is not permeable and the lower area is relatively strongly permeable, and the convection element is configured in this embodiment in the shape of a "crown" that is placed inversely into the liquid volume. This allows for the convection zone 367 to be configured as illustrated in FIG. 10. However, alternative convection elements 342 that are in some way less permeable at the top than at the bottom may be used. For example, a convection element with holes that have a larger passage cross section with respect to their shape or member than holes in the upper area could be used. Alternative elements for generating the convection flow 367, as shown in FIG. 10, may also be used.

To secure the motor in case of a bearing problem, the emergency bearing 344 is provided, configured to secure the motor shaft 306 between the rotor 370 and the radial impeller 304. In particular, the further gap 313 extends through a bearing gap of the emergency bearing or advantageously through drilled holes that are introduced in the emergency bearing on purpose. In an implementation, the emergency bearing is provided with a multitude of drilled holes so that the emergency bearing itself represents a lowest possible flow resistance for the vapor flow 10 for the purpose of the convective vapor cooling.

Figure 12:
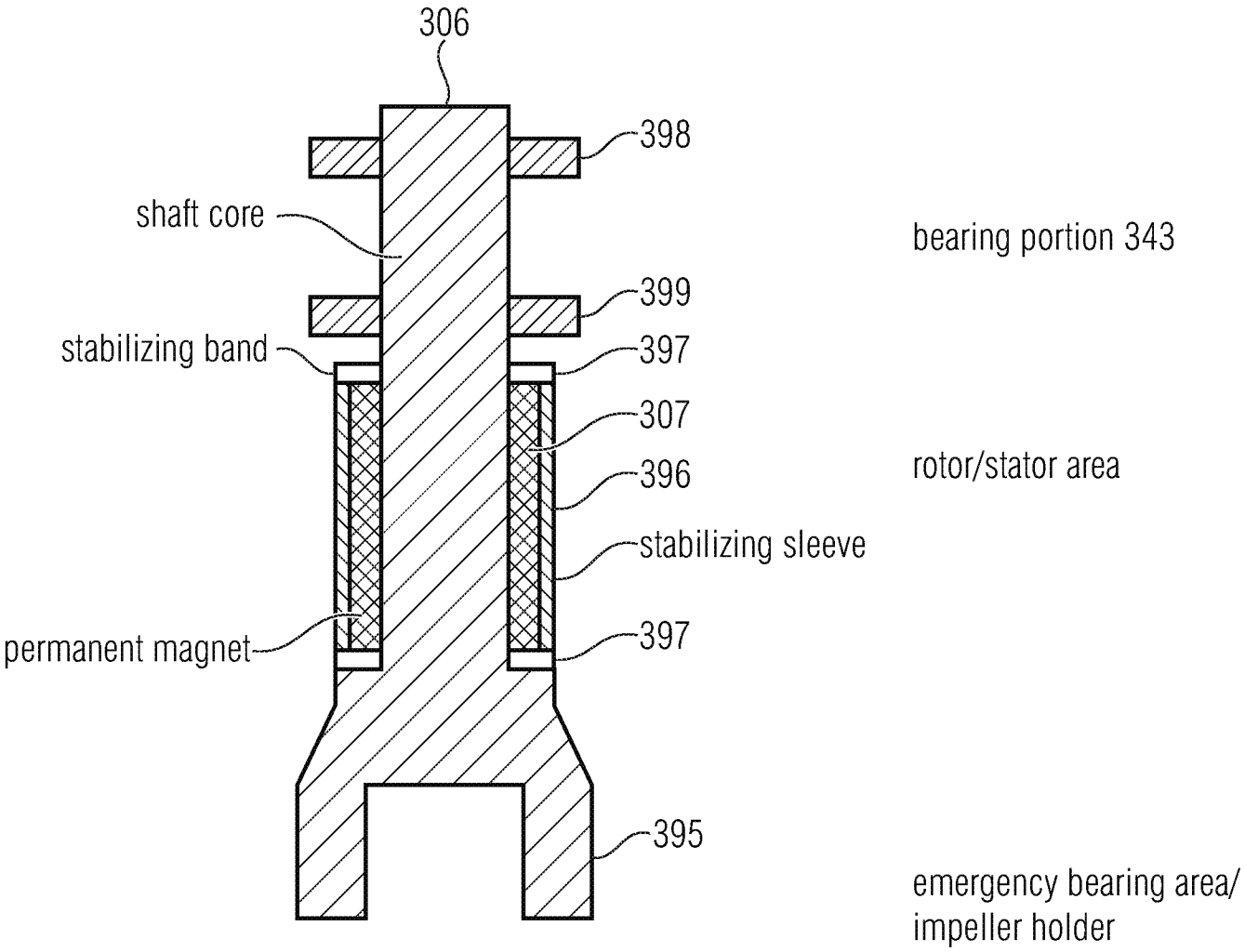
FIG. 12 shows a cross-section through a motor shaft having a bearing portion.

FIG. 12 shows a schematic cross section of a motor shaft 306, as may be used for embodiments. The motor shaft 306 includes a hatched core, as is illustrated in FIG. 12, that is supported in its upper portion, which represents the bearing portion 343, by advantageously two ball bearings 398 and 399. Further down at the shaft 306, the rotor is configured with permanent magnets 307. These permanent magnets are placed onto the motor shaft 306 and are supported at the top and the bottom by stabilizing bands 397 advantageously made of carbon. Furthermore, the permanent magnets are held by a stabilizing sleeve 396 that is also advantageously configured as a carbon sleeve. This securing/stabilizing sleeve leads to the fact that the permanent magnets remain safely on the shaft 306 and cannot detach from the shaft due to the very strong centrifugal forces caused by the high speed of the shaft.

Preferably, the shaft is made of aluminum and has a fixing portion 395 that is fork-like in its cross section and represents a holder for the radial impeller 304 if the radial impeller 304 and the motor shaft are not configured integrally, but using two elements. If the radial impeller 304 is configured integrally with the motor shaft 306, the impeller holding portion 395 is not present, but the radial impeller 304 is directly connected to the motor shaft. As can be seen in FIG. 10, the emergency bearing 344, which is advantageously also made of metal and in particular of aluminum, is located in the area of the bearing holder 395.

Furthermore, the motor housing 300 of FIG. 10, which is also illustrated in FIG. 3, is configured to obtain a pressure that is at most 20% higher than the pressure in the condenser housing during operation of the heat pump. Furthermore, the motor housing 300 may be configured to obtain a pressure that is low enough that bubble boiling occurs in the liquid working medium 328 and in the motor housing 300 when the motor wall 309 is heated during operation of the motor.

Preferably, the bearing portion 346 is further arranged above the maximum liquid level so that no liquid working medium may reach into the bearing portion even if the motor wall 309 is not sealed. On the other hand, the area of the motor that at least partially includes the rotor and the stator is below the maximum level since the largest heat loss that may be transported away in an ideal manner by the convective bubble boiling occurs in the bearing area, but also between the rotor and the stator.

FIG. 10 illustrates how working liquid used during the motor cooling may be fed via the inlet 324 on the top side of the guide space 302. To this end, the passage 377 is provided, which is configured in the upper plate of the condenser volume and may include, depending on the implementation, a single channel on one side or two channels on both sides or even sector-shaped channels in order to be able to let overflow as much overflowing working liquid as possible, as is illustrated by the arrows 367, said working liquid being supplied via the inlet 362 to the ball bearing cooling and led from the ball bearing cooling 366 to the motor wall. The liquid medium then flows out of the motor cooling into the area and is discharged via the inlet 324 if a certain level has been reached. Alternatively, the outlet line 324 may also be contained in the volume of the motor cooling, i.e. in the area in which the convection element 342 is arranged as well. However, it is advantageous to fill the entire area within and outside of the convection element with liquid and to then lead away the overflowing liquid via the overflow 324, lead it through the passage 377 and then guide it from there onto the guide space, or the top side of the guide space, after which the liquid flows down. Thus, FIG. 10 represents an implementation in which only the top side of the guide space is cooled, wherein the special shape of the outer area of the guide space to provide the recessed area 362 is not required.

Figure 9:
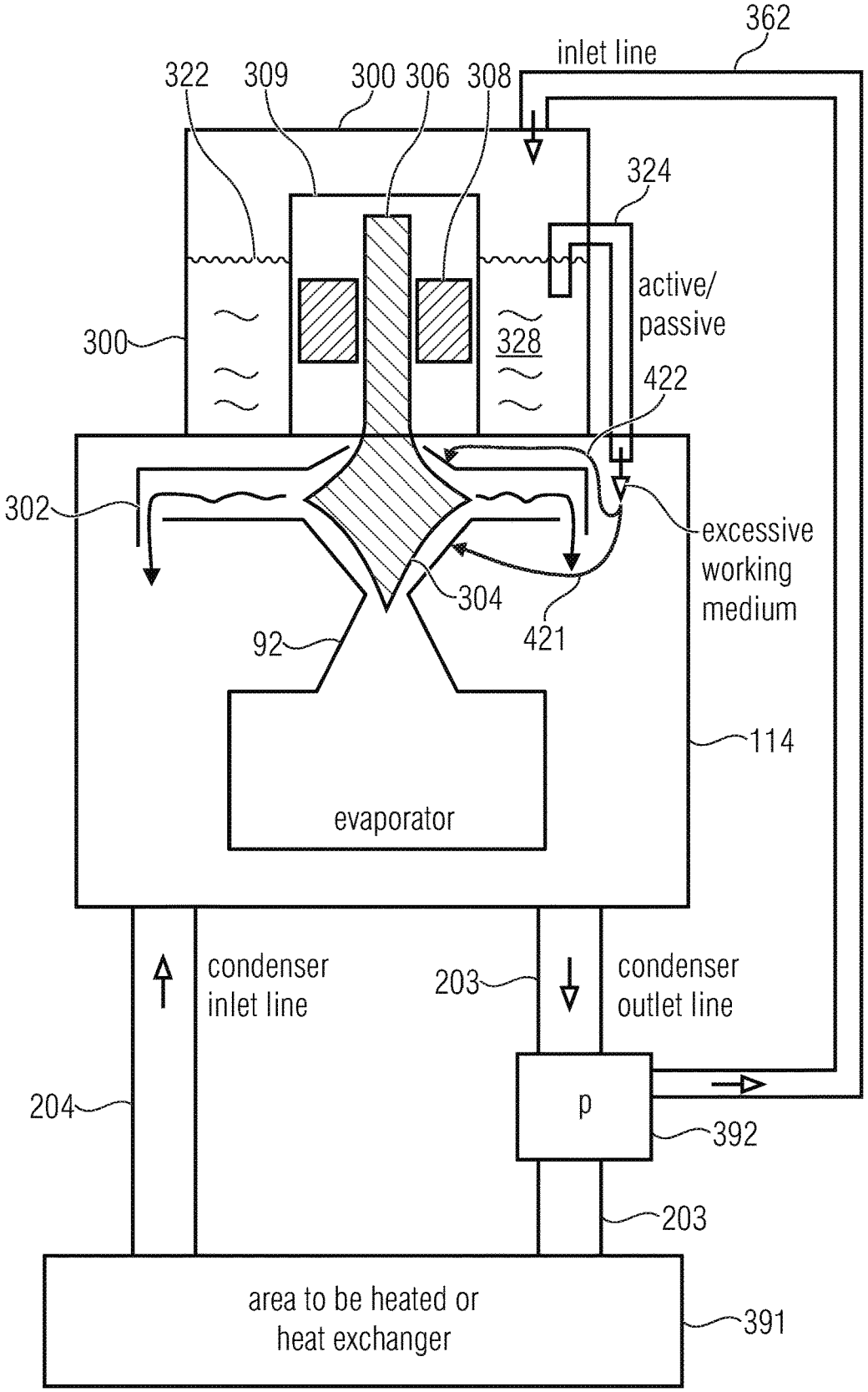
FIG. 9 shows a schematic illustration of a heat pump with a motor cooling according to the second aspect.

FIG. 9 further shows a schematic illustration of the heat pump for motor cooling. In particular, the working medium outlet 324 is configured as an alternative to FIG. 4 of FIG. 20. The outlet does not have to be a passive outlet, but may be an active outlet. e.g. controlled by a pump or any other element and sucking some working medium out of the motor housing 300 depending on a level detection of the level 322. Alternatively, instead of the tube-shaped outlet 324, a re-closable opening could be located at the bottom of the motor housing 300 in order to let a controllable amount of working liquid flow from the motor housing into the condenser by quickly opening the re-closable opening.

FIG. 9 further shows the area to be heated, or a heat exchanger 391 from which a condenser inlet line 204 runs into the condenser, and out of which a condenser outlet line 203 exits. Furthermore, a pump 392 is provided in order to drive the circuit consisting of the condenser inlet line 204 and the condenser outlet line 203. The pump 392 advantageously comprises a branch to the inlet line 362, as is schematically illustrated. Thus, a separate pump is not necessary, but the pump available to the condenser outlet line also drives a small part of the condenser output into the inlet line 362 and therefore into the liquid volume 328.

In addition, FIG. 9 shows a general illustration of the condenser 114, the compressor motor having a motor wall 309 and the motor housing 300, as described based on FIG. 3.

FIG. 9 further shows the overflow 324 as an alternative implementation, where liquid may be actively sucked out and directly supplied to the guide space 302, or the suction mouth 92, again via the lines 421, 422, for example. In addition, as already illustrated in FIG. 9, it is advantageous that heated liquid out of the condenser outlet line 203 is used as the cooling liquid.

FIG. 11 shows an embodiment that unites the functionalities of different illustrated embodiments. A working liquid, or cooling liquid, which is advantageously water, is supplied via the inlet 330, or 362, as is illustrated in FIG. 9, first for the ball bearing cooling, shown as a closed volume 364. A cooling liquid entering the closed volume 364 flows past the ball bearing, which is surrounded by the closed volume, and exits out of the ball bearing. The cooling liquid flows via the connection line, or the tube 366, into the motor cooling space, which is maintained at a level 322 of working liquid. The level 322 is maintained via a wall 321. In particular, the working liquid is supplied via the line 366 advantageously on the low side into the area within the wall 321, as also illustrated in FIG. 10. With this, a good convection zone is obtained, wherein bubble boiling occurs in particular at the heated motor wall. The working liquid further overflows at the wall, as shown at 324, 324 may represent a channel-shaped overflow, however, it may be any free overflow. The liquid then flows down the outside of the wall 321 and then via the passage area, or the passage opening 377, onto the flow area 376. Then, it flows down from this flow area 376 in order to finally land on top of the guide space in the recessed area.

FIG. 11 therefore shows an embodiment in which a ball bearing cooling, a motor cooling, a cooling of the top side of the guide space, a cooling of the suction mouth, a cooling of the bottom side of the guide space and additionally an open cooling of the vapor flow through the overflow-projection distance between the end of the element 381 and the element 382 is obtained, wherein this open area advantageously extends in an angular manner.

The course of the cooling liquid therefore extends via the feed line 422, 324, 377, 376 onto the upper outer side 372 of the guide space 302. From there, the liquid flows via the outlet line 378 from the outside of the guide space 302 to the outside of the suction mouth 92. From there, the liquid flows via the cooling channel 379 along the outside of the suction mouth to the lower outside of the guide space and along the lower outside of the guide space to the overflow 382 and from there down into the condenser.

According to the invention, this achieves that, after compression, the strong overheating of the water vapor otherwise occurring in the uncooled guide space is avoided. Part of the pressure build-up takes place in the guide space, where overheating is also reduced by the cooling, increasing the efficiency and the process quality of the compression process. Overheated water vapor has a higher viscosity and therefore a higher flow resistance and saturated vapor. Overheated water vapor is to therefore first reduce its overheating so that it may easily condense. Preferably, the guide space 302 and the suction mouth 92 are formed from a material with a good thermal conductivity, such as metal. The heat from the vapor flow may then be reduced particularly well, although good results may also be achieved with poorer heat-conducting materials. By reducing the overheating of the vapor flow, the flow resistance is reduced and the condensability of compressed vapor is improved.

In order to keep the temperature of the guide space as close as possible to the saturated vapor temperature of the pressure prevailing in the condenser, the guide space is made of metal and surrounded by liquid, such as water, which performs a pressure compensation with the liquefier. If energy/heat from the vapor flow is coupled in, the surrounding water begins to boil and releases the energy again. This keeps the guide space very close to the saturated vapor temperature of the vapor pressure. Liquefaction in the guide space is prevented by the remaining thermal resistance of the materials and the resulting low overheating.

The cooling water for the guide space is passed through the bearings and also the open motor cooling beforehand. Due to the open motor cooling, the water cools down again to the saturated water temperature by partial evaporation and is available for the open guide space cooling. At first, the upper part of the guide space is filled with water. With a one-sided guide space cooling, the water would simply overflow, as is the case in the embodiment shown in FIG. 10. In an embodiment shown in FIG. 11, the water from the upper guide space cooling is guided into the lower guide space/suction mouth cooling. At the end of the guide space, there is an open area with an overflow. Through evaporation, the water continuously cools itself to the saturated vapor temperature. The remaining water overflows and flows into a collection basin. As is shown in FIG. 2, a balance between the condenser 114 and the evaporator 90 maybe carried out via a throttle 91. However, a throttle is not necessary in an open system.

In addition to the advantages mentioned above, the reduced stress of thermal components is another advantage. Through the evaporation cooling, the entire compressor may be kept near the saturated vapor temperature despite losses. Through the evaporation, motor losses, bearing losses and losses in the compression are reduced.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

LIST OF REFERENCE NUMERALS

10 evaporator
12 suction pipe
14 compressor-liquefier system
16 turbo-machine
18 liquefier
20*a* advance flow line
20*b* return flow line
22 outflow line
90 evaporator
91 throttle
92 suction mouth
100 heat pump
102 evaporator space
106 condenser bottom
108 evaporator bottom
110 motor
112 compressed working vapor
114 condenser housing
115 suction opening/suction mouth
200 liquefier bottom
201 sealing washer
202 liquefier housing portion
203 liquid outlet line
204 liquid inlet line
205 vapor feed
207 schematic boundary
210 liquid transport area
212 liquid distribution element
213 vapor guide area
215 vapor inlet gap
217 lateral boundary
220 vapor flow directions
300 motor housing
302 guide space
304 radial impeller
306, 307 rotor
308 stator
309 motor wall
310 vapor feed
311 motor gap
312 pressure area
313 further gap
314 working vapor
315 cooling fins
317, 320 vapor feed
322 level
323 vapor space
324 working medium outlet seal
328 liquid volume
330 working medium inlet
342 drain
343 bearing portion
344 emergency bearing
346 course of the further gap
351 O-rings
360 splash guard
362 inlet
364 sealed volume
366 guide portion
367 convection zone
370 rotor
391 heat exchanger
372 recessed area
373 area for drainage line
374 drainage line
376 flow area
377 motor housing passage
379 cooling channel
380 bottom of the cooling channel
381 lower guide space end
382 projection
392 pump
395 fixing portion
396 securing sleeve
397 stabilizing bands
398 ball bearing
399 ball bearing
402 condenser water feed
404 droplet separator
405 blades
406 grooves
408 condenser water
409 edge
410 schematic boundary
420 cooling device
421 suction mouth liquid line
422 guide space liquid line

The invention claimed is:

1. A heat pump, comprising:

an evaporator for evaporating a working liquid;

a condenser configured for condensing a compressed working vapor;

a compressor motor with a suction mouth having attached thereto a radial impeller configured to convey an evaporated working vapor evaporated in the evaporator through the suction mouth;

a guide space arranged to guide a working vapor conveyed by the radial impeller into the condenser; and a cooling device configured for cooling the guide space and the suction mouth with a liquid for cooling, wherein a lower outside of the guide space is not in contact with the working vapor conveyed by the radial impeller, and wherein an inside of the guide space is in contact with the working vapor conveyed by the radial impeller, wherein an outside of the suction mouth and the lower outside of the guide space are connected to each other in a vapor-sealed manner, and wherein the cooling device is configured to guide the liquid for cooling in a flow sequentially on the outside of the suction mouth and then on the lower outside of the guide space, or to guide the liquid for cooling in a flow sequentially on the lower outside of the guide space and then on the outside of the suction mouth.

2. The heat pump according to claim 1, wherein an outside of the guide space further comprises an upper outside, and wherein the cooling device is configured to guide the liquid for cooling onto the upper outside, the lower outside, or the upper outside and the lower outside of the guide space.

3. The heat pump according to claim 1, wherein the liquid for cooling is the working liquid of the heat pump.

4. The heat pump according to claim 1, wherein, during an operation of the heat pump, a pressure in the condenser is essentially equal to a pressure present at the lower outside of the guide space or at the outside of the suction mouth.

5. The heat pump according to claim 1, wherein an outside of the guide space further comprises an upper outside, and wherein the cooling device comprises:

a supply line configured for supplying the liquid for cooling onto the upper outside of the guide space;

a carry-off line configured for carrying off the liquid for cooling from the upper outside of the guide space to the outside of the suction mouth for cooling the suction mouth;

a cooling channel for guiding the liquid for cooling that is output by the carry-off line along the outside of the suction mouth to the lower outside of the guide space and along the lower outside of the guide space; and an overflow configured for guiding the liquid for cooling from the lower outside of the guide space.

6. The heat pump according to claim 5, wherein the overflow is configured to project beyond an end of the lower outside of the guide space by a distance that is larger than 1 cm, and wherein the overflow comprises a projection to hold in the distance by which the overflow projects a level of the liquid for cooling that is larger than 2 mm.

7. The heat pump according to claim 5, wherein the upper outside of the guide space comprises a recess configured to hold the liquid for cooling provided by the supply line, wherein the carry-off line is attached to an area in the recess that is below an available level of the liquid for cooling in the recess during an operation of the heat pump.

8. The heat pump according to claim 5, wherein a level of the supply line is higher than a level of the overflow so that, during an operation of the heat pump, a flow of the liquid for cooling takes place through the supply line, the carry-off line and the cooling channel due to gravity.

9. The heat pump according to claim 1, configured to convey a flow of the evaporated working vapor through the suction mouth upwards in a direction perpendicular to an operation direction of the heat pump, and wherein the guide space is configured to deflect a flow of the vapor conveyed by the radial impeller from a horizontal flow at the end of the radial impeller into a flow directed downward into the condenser.

10. The heat pump according to claim 1, wherein the guide space comprises a circular shape in a top view and comprises a circular recess at its outer edge, and wherein the cooling device is configured to fill the recess with the liquid.

11. The heat pump according to claim 1, wherein the guide space and the suction mouth are circular in a view from below, wherein the suction mouth transitions into the guide space, wherein the cooling device comprises a cooling channel formed by a cooling channel wall spaced apart from a bottom side of the suction mouth and of the guide space, said cooling channel wall also being configured in a circular shape and arranged such that liquid for cooling supplied into the cooling channel by the cooling device is held by the cooling channel wall and is in contact with the outside of the suction mouth and the lower outside of the guide space.

12. The heat pump according to claim 1, wherein the condenser comprises a condenser housing, wherein the compressor motor is attached to the condenser housing and comprises a rotor and a stator, wherein the rotor comprises a motor shaft having attached thereto the radial impeller for compressing the evaporated working vapor, wherein the compressor motor comprises a motor wall, wherein a motor housing surrounding the compressor motor and comprising a working medium inlet is configured to guide the liquid for cooling for a motor cooling to the motor wall, and wherein the motor housing is further configured, during an operation of the heat pump, to carry off the liquid for cooling for the motor cooling via a passage from the motor housing to an upper outside of the guide space.

13. The heat pump according to claim 12, wherein the compressor motor further comprises a bearing portion supporting the rotor with respect to the stator, wherein the compressor motor is arranged in the motor housing such that the bearing portion is above a maximum level of the liquid for cooling, or wherein the compressor motor is attached to the motor housing such that an area of the compressor motor that at least partially comprises the rotor and the stator is arranged below a maximum level of the liquid for cooling.

14. The heat pump according to claim 12, comprising a motor housing overflow that projects into the motor housing and defines a maximum level of the liquid for cooling, wherein the motor housing overflow extends from the motor housing via the passage into the condenser, and wherein the motor housing overflow further represents a vapor passage for a vapor from a vapor space into the condenser so that a pressure in the motor housing and a pressure in the condenser housing are essentially equal.

15. The heat pump according to claim 14, wherein the motor housing overflow is configured to guide the liquid for cooling above the maximum level for the liquid for cooling in the motor housing into the condenser and to simultaneously create a vapor path between the vapor space and the condenser.

16. The heat pump according to claim 1, wherein the compressor motor comprises a ball bearing, wherein a sealed volume is arranged around the ball bearing, wherein the cooling device is configured to guide the liquid for cooling into the sealed volume, to guide the liquid for cooling out of the sealed volume, and to then provide the liquid for cooling to the guide space or to the suction mouth either directly or via a motor cooling.

17. The heat pump according to claim 16, wherein the cooling device is configured to guide the liquid for cooling out of the sealed volume around the ball bearing of the motor and to then guide the liquid for cooling to a bottom of a motor housing.

18. The heat pump according to claim 1, wherein the compressor motor comprises a motor shaft, and wherein the motor shaft comprises:

a shaft core;

a magnet area with permanent magnets fixed on the shaft core;

a securing sleeve arranged around the magnet area for securing the permanent magnets, wherein the compressor motor is attached in a motor housing such that the magnet area is positioned below a maximum level of the liquid for cooling.

19. The heat pump according to claim 1, wherein the compressor motor comprises a ball bearing and a ball bearing cooling device and a motor cooling device, wherein the ball bearing cooling device is configured to supply the liquid for cooling into a sealed volume located at the ball bearing, wherein the motor cooling device is configured to guide the liquid for cooling carried off out of the sealed volume to a motor wall, wherein the motor cooling device is configured to comprise a liquid for cooling overflow over which the liquid for cooling overflows, and wherein the cooling device for the guide space is configured to collect the liquid for cooling overflowed from the motor cooling device and to use the liquid for cooling overflowed from the motor cooling device for cooling the guide space and for cooling the suction mouth.

20. The heat pump according to claim 19, wherein the motor cooling device and the cooling device are configured to work at a pressure being equal to a pressure that is present in the condenser of the heat pump.

21. A method for pumping heat with an evaporator configured for evaporating a working liquid; a condenser configured for condensing a compressed working vapor; a compressor motor with a suction mouth having attached thereto a radial impeller to convey an evaporated working vapor evaporated in the evaporator through the suction mouth; and a guide space arranged to guide a working vapor conveyed by the radial impeller into the condenser, comprising:

cooling the guide space and the suction mouth with a liquid for cooling, wherein a lower outside of the guide space is not in contact with the working vapor conveyed by the radial impeller and wherein an inside of the guide space is in contact with the working vapor conveyed by the radial impeller, wherein an outside of the suction mouth and the lower outside of the guide space are connected to each other in a vapor-sealed manner, and wherein the cooling comprises guiding the liquid for cooling in a flow sequentially on the outside of the suction mouth and then on the lower outside of the guide space, or guiding the liquid for cooling in a flow sequentially on the lower outside of the guide space and then on the outside of the suction mouth.

22. A method for manufacturing a heat pump with an evaporator configured for evaporating a working liquid; a condenser configured for condensing a compressed working vapor; a compressor motor with a suction mouth having attached thereto a radial impeller to convey an evaporated working vapor evaporated in the evaporator through the suction mouth; and a guide space arranged to guide a working vapor conveyed by the radial impeller into the condenser, comprising:

attaching a cooling device configured for cooling the guide space with a liquid for cooling, wherein a lower outside of the guide space is not in contact with the working vapor conveyed by the radial impeller and wherein an inside of the guide space is in contact with the working vapor conveyed by the radial impeller, wherein an outside of the suction mouth and the lower outside of the guide space are connected to each other in a vapor-sealed manner, and wherein the cooling device is configured to guide the liquid for cooling in a flow sequentially on the outside of the suction mouth and then on the lower outside of the guide space, or to guide the liquid for cooling in a flow sequentially on the lower outside of the guide space and then on the outside of the suction mouth.

* * * * *